United States Patent [19]

Kuzunuki et al.

[11] 4,081,059

[45] Mar. 28, 1978

[54] ELEVATOR CONTROL SYSTEM

[75] Inventors: Soshiro Kuzunuki; Kotaro Hirasawa, both of Hitachi; Tatsuo Iwasaka; Takashi Kaneko, both of Katsuta, all of Japan

[73] Assignee: Hitachi, Ltd., Japan

[21] Appl. No.: 730,261

[22] Filed: Oct. 5, 1976

[30] Foreign Application Priority Data

Oct. 11, 1975 Japan ..... 50-121837
Apr. 18, 1976 Japan ..... 51-44314

[51] Int. Cl.[2] ..... B66B 1/18
[52] U.S. Cl. ..... 187/29 R
[58] Field of Search ..... 187/29

[56] References Cited

U.S. PATENT DOCUMENTS

| | | | |
|---|---|---|---|
| 3,511,344 | 5/1970 | DeLamater | 187/29 |
| 3,746,131 | 7/1973 | Hirasawa et al. | 187/29 |
| 3,804,209 | 4/1974 | Edison | 187/29 |
| 4,030,571 | 6/1977 | Kaneko et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

An elevator control system for controlling a plurality of elevator cars arranged for parallel operation for servicing a plurality of floors of a building, in which means are provided so that, in response to origination of a new hall call in addition to hall calls originated and allotted already, a suitable elevator car for servicing this new hall call can be selected and the new hall can be allotted to the selected elevator car to be serviced by this elevator car. In the system, this new hall call is allotted preferentially to one of the elevator cars having an already instructed stopping floor within a predetermined floor range covering a plurality of backward and/or forward floors contiguous to the new hall call originating floor. In this elevator control system, the already instructed stopping floor is evaluated by employing a weight coefficient which is variable depending on the factor such as the position of the already instructed stopping floor either backward or forward relative to the new hall call originating floor, or the relative distance between such floor and the new hall call originating floor, so as to provide improved elevator service.

26 Claims, 24 Drawing Figures

ELEVATOR CONTROL SYSTEM

This invention relates to an elevator control system for controlling a group of elevator cars, and more particularly to the art of allotment of hall calls to such elevator cars for providing improved elevator service.

An elevator control system is provided for controlling a plurality of elevator cars arranged for parallel operation for servicing a plurality of floors of a building and is required to efficiently control the operation of the elevator cars by bringing these elevator cars into proper correlation in order to achieve good elevator service.

Various methods for allotting a new hall call to a most suitable elevator car have been proposed to efficiently control the operation of a plurality of elevator cars arranged for parallel operation for servicing a plurality of floors of a building. According to one of the proposed methods, an elevator car which is forecast to arrive at the new hall originating floor earliest of all is detected, and the new hall call is allotted to this elevator car. According to another proposed method, the new hall call is merely allotted to an elevator car which is located nearest to the new hall call originating floor. In these methods, however, the relative interval between the individual elevator cars is not taken into account in allotting the new hall call. In other words, the new hall call is simply allotted to one of the elevator cars on the grounds that this elevator car can arrive at the new hall call originating floor earliest of all or it is located nearest to the new hall call originating floor, and the change in the relative interval between the individual elevator cars due to the allotment of the new hall call to the selected one is not taken into account. Therefore, the individual elevator cars will not be uniformly distributed throughout the entire floor range of the building, and such non-uniform elevator car distribution will extremely degrade the elevator service for all the hall calls originated from the floors of the building. For example, an increase in the traffic demand may give rise to such a situation that a bunch of elevator cars run together in the same direction without any substantial effective interval therebetween. Such an undesirable situation is called bunched running herein. This bunched running is also seen in traffic facilities such as buses, and in such a case too, a group of buses run together past the same spot without any substantial effective interval therebetween although they have dispatched the same starting point at different times. Once such bunched running occurs, this state is substantially maintained until the traffic demand is reduced. In the state of bunched running, therefore, the elevator cars running in bunch can only provide extremely delayed service for hall calls originated from the floors remote from their running floor range, although they can readily service hall calls originated from the floors near their running floor range. Thus, the elevator service for all the hall calls originated from the floors of the building is extremely degraded, resulting in an increase in the average waiting time and non-uniformity of the waiting time at the individual floors. Further, there may be some hall calls which are not serviced within an appropriate waiting time, and the passengers waiting in the hall must wait for a long period of time. Such hall calls will be referred to hereinafter as long-waiting hall calls.

It is therefore a primary object of the present invention to obviate such prior art defects and to provide an improved elevator control system which shortens and makes substantially uniform the length of time for which the passengers originating the hall calls must wait and which minimizes long-waiting hall calls thereby ensuring better elevator service.

In one of the prior art allotting methods referred to hereinbefore, a new hall call is allotted to the elevator car which can arrive at the new hall call originating floor earliest of all, that is, the new hall call is allotted to the elevator car providing a minimum waiting time. In such prior method, however, an increase in the traffic demand tends to give rise to the so-called bunched running of the elevator cars, and this state of bunched running lasts generally for a considerable period of time and is not released so early. In such a case, some of hall calls are not properly serviced to leave the so-called long-waiting hall calls. Such an unfavorable situation occurs due to the fact that a new hall call is allotted to one of the elevator cars on the basis of the time interval factor alone, and the spatial interval factor between the elevator cars is not taken into account. In the present invention, this spatial interval factor between the elevator cars is also taken into account to eliminate the undesirable bunched running of the elevator cars.

In accordance with the present invention, there is provided an elevator control system for controlling a plurality of elevator cars arranged for parallel operation for servicing a plurality of floors of a building, comprising hall call registering means disposed at each floor, car call registering means disposed in each said elevator car for instructing target floors, means for selecting a suitable one of said elevator cars in response to the origination of a new hall call from one of the floors, and means for allotting this new hall call to said selected elevator car so that said selected elevator car can service this new hall call, wherein the improvement comprises means for detecting for each said elevator car the number of already instructed stopping floors within a predetermined floor range covering a plurality of backward or forward floors contiguous to said new hall call originating floor, and means for preferentially allotting the new hall call to one of said elevator cars having said already instructed stopping floors within said predetermined floor range.

The above and other objects, features and advantages of the present invention will become apparent from the following detailed description taken in conjunction with the accompanying drawings, in which:

FIGS. 4 to 14 are circuit diagrams showing the practical structure of various circuits employed in the first embodiment of the present invention, in which:

FIG. 4 is a circuit diagram of a circuit for computing the number of forecast in-car passengers classified by their target floors;

FIG. 5 is a circuit diagram of a circuit for computing the number of passengers waiting in the hall of each floor;

FIG. 6 is a circuit diagram of a circuit for forecasting the number of in-car passengers at each of the successive floors;

FIG. 7 is a circuit diagram of a circuit for computing the forecast waiting time at each of the successive floors;

FIG. 8 is a circuit diagram of a circuit for computing the length of time elapsed after the origination of a hall call;

FIG. 9 is a circuit diagram of a circuit for determining the serviceability of each elevator car on the basis of the detected number of in-car passengers classified by their target floors;

FIG. 10 is a circuit for determining the serviceability of each elevator car on the basis of the computed forecast waiting time;

FIG. 11 is a circuit diagram of a circuit for detecting an elevator car instructed already to stop at a floor lying backward or forward relative to a new hall call originating floor within a predetermined floor range;

FIG. 12 is a circuit diagram of a circuit for detecting an elevator car capable of servicing the new hall call;

FIG. 13 is a circuit diagram of a circuit for selecting an elevator car providing a minimum forecast waiting time at the new hall call originating floor; and FIG. 14 is a circuit diagram of a circuit for allotting the new hall call to the elevator car selected by the circuit shown in FIG. 13;

FIGS. 15 and 16 show a modification of the first embodiment of the present invention, in which:

FIG. 15 is a modification of the circuit shown in FIG. 11; and

FIG. 16 is a modification of the circuit shown in FIG. 12;

In the present specification, the terms "backward" and "forward" are used throughout to designate the relation between one of floors originating a new up hall call and the remaining floors. Thus, when, for example, a building has ten floors, and a new up hall is originated from the sixth floor, the first to fifth floors are backward floors, and the seventh to 10th floors are forward floors.

A first embodiment of the elevator control system according to the present invention will now be described.

Figure 1:
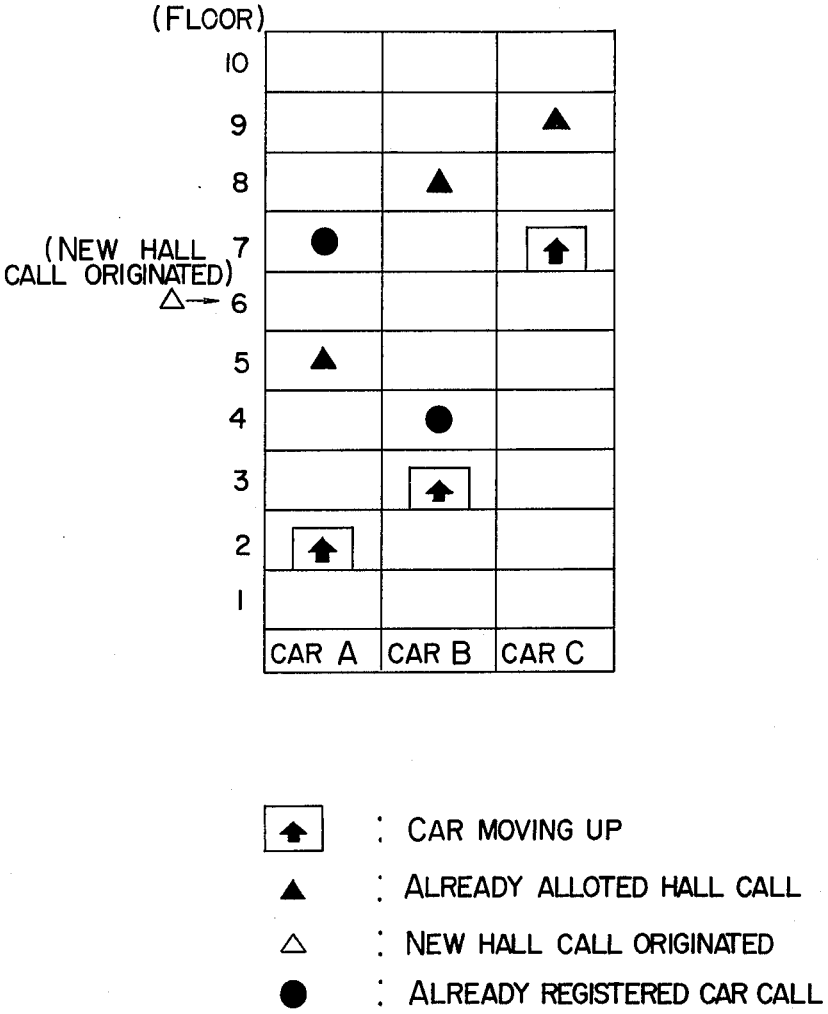
FIG. 1 is a diagrammatic view illustrating the basic principle of the elevator control system according to the present invention.

FIG. 1 illustrates the basic principle of the first embodiment of the present invention for allotting a new hall call to a suitable elevator car in order to eliminate the so-called bunched running. Referring to FIG. 1, three elevator cars A, B and C are arranged for parallel operation for servicing the first to 10th floors of a building having 10 floors. In FIG. 1, the elevator cars A, B and C are shown located at the second, third and seventh floors respectively for upward movement. An up hall call (represented by the black triangle) is originated from the fifth floor and allotted already to the elevator car A, and a car call (represented by the black circle) is registered in the elevator car A to demand stopping of the elevator car A at the seventh floor. An up hall call is originated from the eighth floor and allotted already to the elevator car B, and a car call is registered in the elevator car B to demand stopping of the elevator car B at the fourth floor. An up hall call is originated from the ninth floor and allotted already to the elevator car C. Suppose now that a new up hall call (represented by the white triangle) is originated from the sixth floor in the state shown in FIG. 1. This new up hall call should be allotted to the elevator car which can provide the best service.

Suppose, for simplicity of explanation, that the length of time required for each elevator car to run one floor interval is 2 seconds, and the length of time required for stopping at one of the floors is 10 seconds. Then, in the case of the elevator car A located at the second floor for upward movement, the number of floor intervals which must be run to arrive at the sixth floor is four, and the number of stops required until it arrives at the sixth floor is one. Therefore, the elevator car A is forecast to arrive at the sixth floor after the length of time $Wt_A$ given by $10 \times 1 + 2 \times 4 = 18$ seconds. Similarly, the elevator car B is forecast to arrive at the sixth floor after the length of time $Wt_B$ given by $10 \times 1 + 2 \times 3 = 16$ seconds, while the elevator car C is forecast to arrive at the sixth floor after the length of time $Wt_C$ given by $10 \times 1 + 2 \times 17 = 44$ seconds. According to the prior art manner of allotment for minimizing the waiting time, the elevator car B is selected to service the new up hall call originated from the sixth floor as it can most quickly service such hall call. Consider now the running state of the elevator cars A and B. The elevator car A stops at the fifth and seventh floors, and the elevator car B stops at the fourth, sixth and eighth floors. Thus, the result is the bunched running of these elevator cars A and B.

Figure 2:
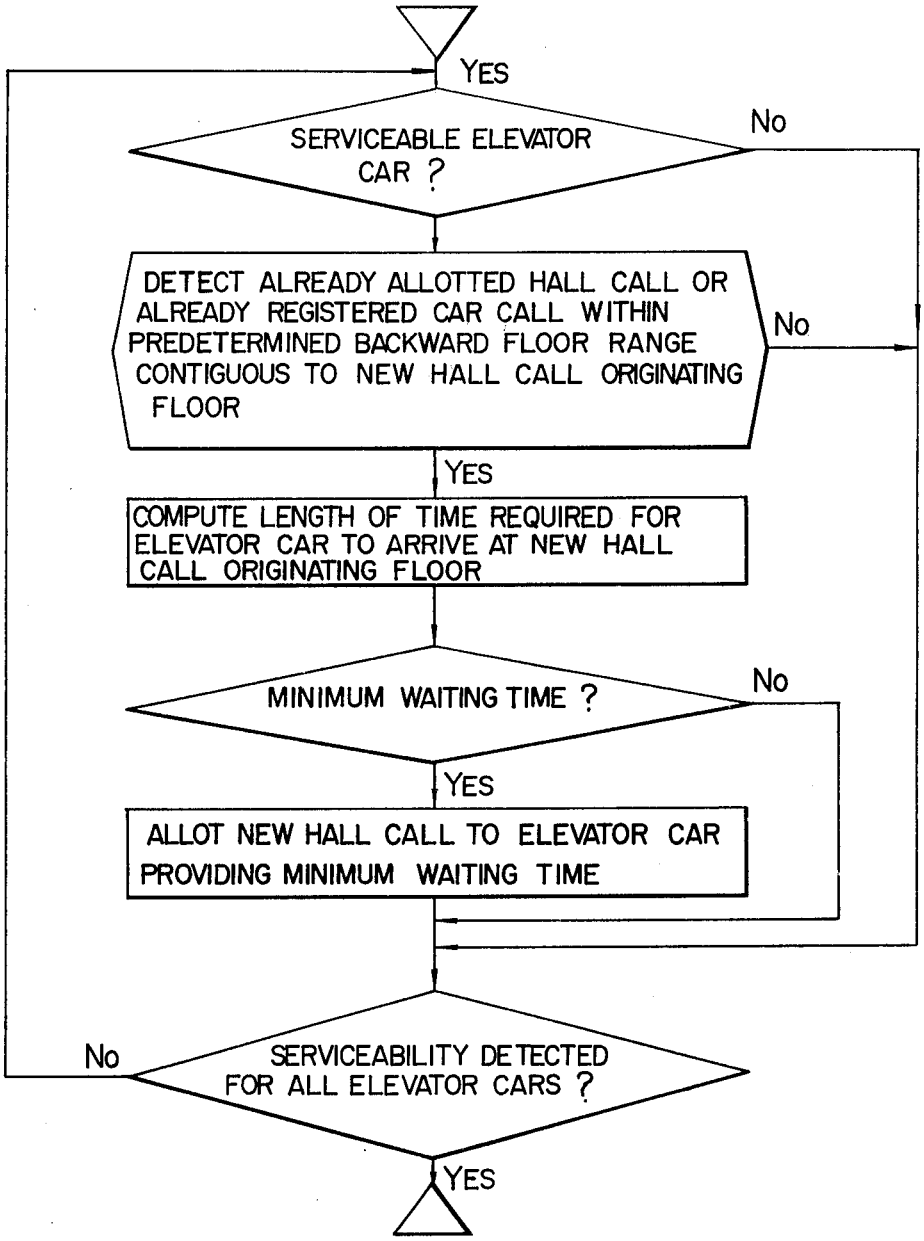
FIG. 2 is a flow chart illustrating the outline of the basic operation of the elevator control system according to the present invention.

In order to prevent such bunched running of the elevator cars, a novel manner of hall call allotment as described with reference to FIG. 2 is employed in the first embodiment of the present invention. FIG. 2 is a flow chart illustrating the outline of the basic operation of the first embodiment for allotting a new up hall call to one of the elevator cars. In the first step, in response to the origination of a new up hall call from one of the floors, the factors such as the loaded condition and the waiting time are taken into account to select a serviceable elevator car which is suitable for servicing the new up hall call. An elevator car is said to be non-serviceable when such elevator car is full loaded before servicing the new up hall call or provides an excessively long waiting time or is disabled due to trouble. The step above described is repeated for another elevator car when the selected elevator car is found non-serviceable. When the selected elevator car is found serviceable, the second step is taken to detect the presence of hall calls or car calls allotted already to the selected elevator car within a predetermined floor range covering a plurality of floors, for example, a plurality of backward floors contiguous to the new up hall call originated floor. When a plurality of elevator cars have hall calls or car calls allotted already thereto within the predetermined floor range, the new up hall call is allotted to the elevator car which can arrive at the new up hall call originating floor earliest of all such elevator cars.

The above manner of hall call allotment will be described with reference to FIG. 1 again. Suppose, for example, that the predetermined floor range covers one backward floor contiguous to the new up hall call originating floor. Then, the fifth floor originating the up hall call already is included within this predetermined floor range, since the new up hall call is originated from the sixth floor. The elevator car A is the only one to which the up hall call originated from the fifth floor is allotted already. According to the method of allotment employed in the present invention, therefore, the new up hall call originated from the sixth floor is allotted to the elevator car A. By virtue of this manner of hall call allotment, the undesirable bunched running of the elevator cars A and B can be obviated, and the average length of waiting time at the individual floors originating the hall calls can be made substantially uniform and shortened. Further, an excessively long waiting time can be avoided. Thus, the present invention can provide improved elevator service.

The structure and operation of the first embodiment of the present invention will be described in detail with reference to FIGS. 3 to 14.

Figure 3:
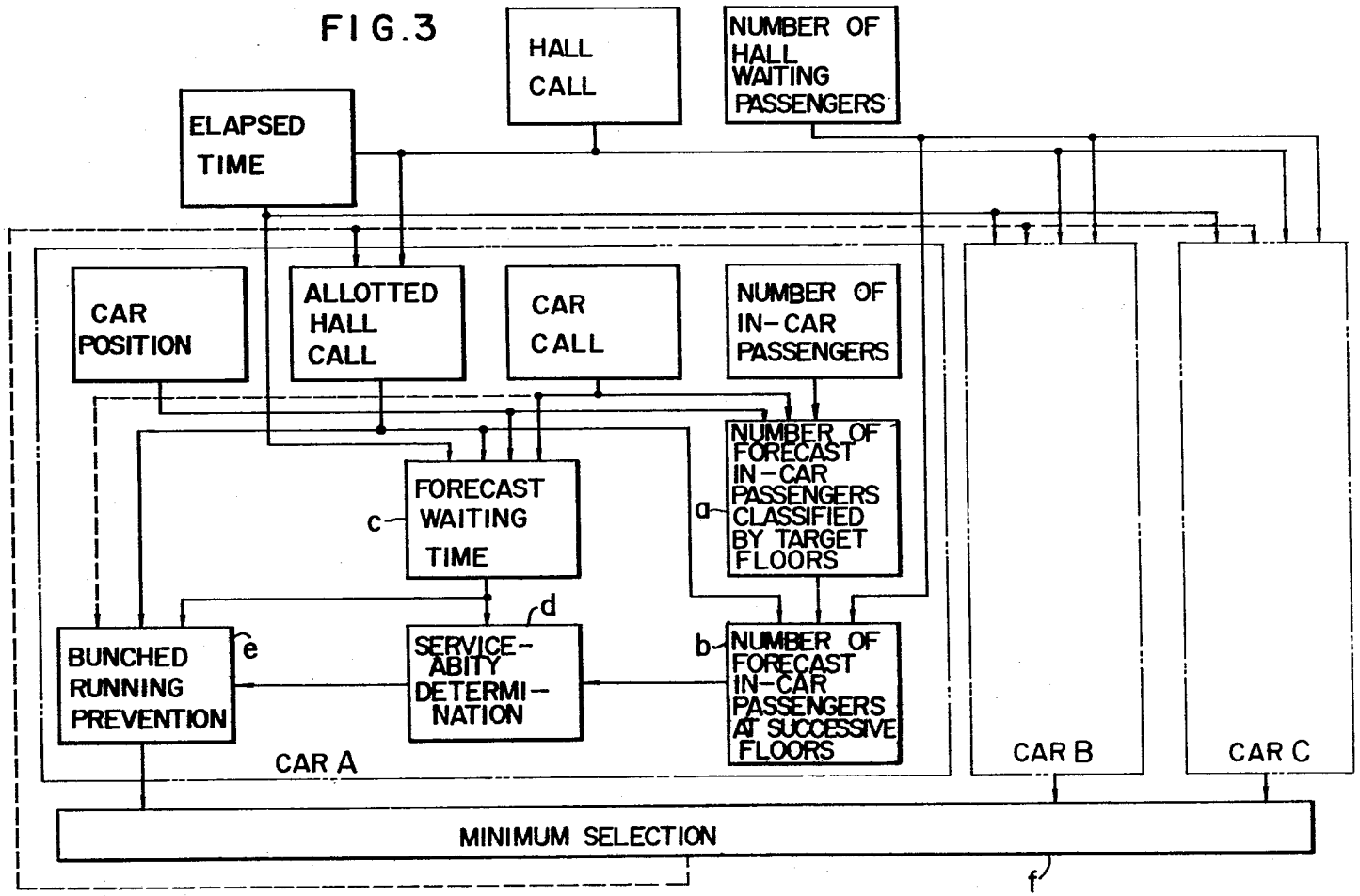
FIG. 3 is a block diagram showing schematically the structure of a first, a second and a third embodiment of the present invention.

FIG. 3 is a block diagram showing schematically the structure of the elevator control system embodying the first form of the present invention. In the following description, it is supposed that three elevator cars A, B and C are arranged for parallel operation to service the first to 10th floors of a building having ten floors.

Referring to FIG. 3 showing means associated with the elevator car A only in detail, the block *a* is a circuit which forecasts by computation the number of passengers (the number of forecast in-car passengers classified by their target floors) getting off and on the elevator car A at the individual floors, and the inputs to this circuit include the elevator car position, the number of registered car calls, and the number of in-car passengers at the initially located floor. The block *b* is a circuit which forecasts by computation the number of passengers (the number of forecast in-car passengers at each of the successive floors) remaining still in the elevator car A at the individual floors, and the inputs to this circuit include the output of block *a* representative of number of forecast in-car passengers classified by their target floors, and the number of passengers waiting in the hall of the allotted hall call originating floors. The block *c* is a circuit which forecasts by computation the total length of time (the forecast waiting time) which is the sum of the length of time required for the elevator car A to arrive at the individual floors and the length of time elapsed after allotment of registered calls, if any, and the inputs to this circuit include the number of allotted hall calls, the length of time elapsed after origination of such calls, the number of car calls, and the elevator car position. The block *d* is a circuit which detects whether the number of forecast in-car passengers at each of the successive floors and the forecast waiting time computed by blocks *b* and *c* respectively are less than predetermined settings or not, and determines the serviceability of the elevator car A for a new hall call. The block *e* is a circuit which makes necessary computation to prevent the bunched running, and the inputs to this circuit include the new hall call, the number of allotted hall calls, the number of registered car calls, the forecast waiting time computed by block *c*, and the output of block *d* indicating the serviceability. The block *c* applies to the block *e* the output representative of the forecast waiting time at the new hall call originating floor when the elevator car A is instructed already to stop at the floor lying within the predetermined floor range contiguous to the new hall call originating floor and can service this new hall call. The block *f* is a circuit which selects an elevator car which can service the new hall call with a minimum forecast waiting time, and the inputs to this circuit include the output representative of the forecast waiting time applied from the block *e* and those applied from similar blocks associated with the elevator cars B and C. In this manner, the new hall call is allotted to the selected elevator car.

The practical structure of various circuits employed in the first embodiment of the present invention will be described in detail with reference to FIGS. 4 to 17.

Figure 4:
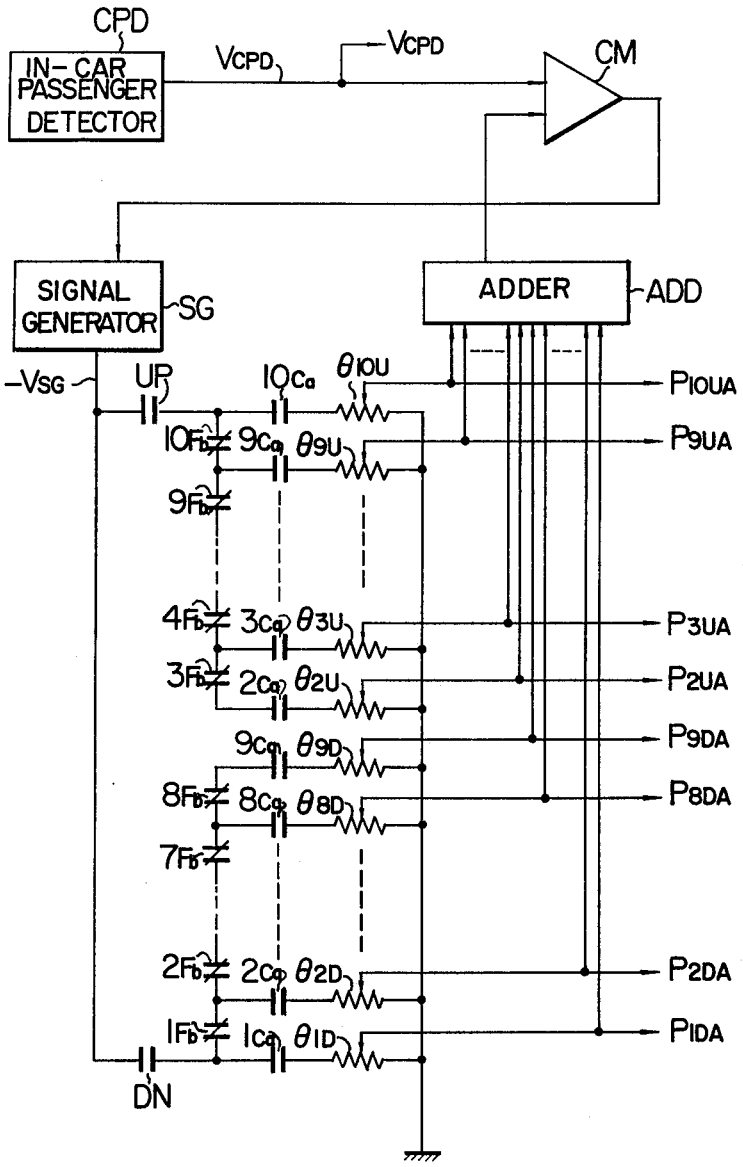

FIG. 4 shows a circuit for computing the number of passengers in each elevator car classified by their target floors. The circuit shown in FIG. 4 is provided for the elevator car A, and it is apparent that similar circuits are also provided for the elevator cars B and C.

An in-car passenger detector CPD such as a weighing means is disposed beneath the floor of the elevator car A to produce an output signal $V_{CPD}$ which is proportional to the number of in-car passengers. Suppose, for example, that the elevator car A is located at the fourth floor for upward movement, and car calls for the ninth and 10th floors are registered by the passengers therein. The output voltage $-V_{SG}$ of a signal generator SG is applied to a variable resistor $\theta$1OU by the route of SG-UP-$\mathbf{10}_{Ca}$-$\theta_{1OU}$, and to another variable resistor $\theta_{9U}$ by the route of SG-UP-$\mathbf{10}_{Fb}$-$\mathbf{9}_{Ca}$-$\theta_{9U}$. These variable resistors $\theta_{1OU}$ and $\theta_{9U}$ are set to provide predetermined settings $\theta_{1OU}$ and $\theta_{9U}$ respectively. Therefore, the outputs P1OU and P9U of these variable resistors $\theta_{1OU}$ and $\theta_{9U}$ are representative of the number of in-car passengers classified by their target floors or the ninth and 10th floors and are given by $-V_{SG}\cdot\theta_{1OU}$ and $-V_{SG}\cdot\theta_{9U}$ respectively. These signals P1OU and P9U are applied to an adder ADD to be added together, and the output of the adder ADD is compared by a comparator CM with the output $V_{CPD}$ of the in-car passenger detector CPD. The absolute value of the output voltage $-V_{SG}$ of the signal generator SG is increased when the sum of the inputs to the comparator CM, that is, $V_{CPD} + (-V_{SG}\cdot\theta_{1OU} - V_{SG}\cdot\theta_{9U})$ is positive. Thus, the comparator CM acts to control the signal generator SG so as to give the relation $V_{CPD} - (V_{SG}\cdot\theta_{1OU} + V_{SG}\cdot\theta_{9U}) = 0$.

Therefore, the voltage signal $V_{CPD}$ representative of the number of in-car passengers at the fourth floor is equal to the sum of the voltage signals P1OU and P9U representative of the number of in-car passengers classified by the target floors or the ninth and 10th floors when the output signal level of the signal generator SG is selected to be equal to the output signal level of the in-car passenger detector CPD.

Therefore, when the traffic demand in the entire floor range of from the first floor to the 10th floor is generally uniform, variable resistors $\theta_{1U}$ to $\theta_{9U}$ and $\theta_{2D}$ to $\theta_{10D}$ may have the same setting so that the in-car passengers may be distributed to their target floors without an appreciable error. Suppose, for example, that the in-car passenger detector CPD (which may be the weighing means) detects the presence of nine in-car passengers, and the car call buttons for the fifth, sixth and seventh floors are depressed by these in-car passengers. Then, the circuit decides that the target floor of three passengers among nine is the fifth floor, that of three passengers among the remaining six is the sixth floor, and that of the remaining three passengers is the seventh floor. Although the circuit is shown in simple form in FIG. 4, the precision of target floor decision will be improved when the number of passengers getting off and on the elevator car is detected along with the traveling movement of the elevator car, and the record or memory of the increase and decrease in the number of in-car passengers is utilized to decide the number of in-car passengers classified by their target floors. Further, the traffic demand in the building, the character of the individual floors in the building and other necessary factors should additionally be taken into account to suitably adjust the settings of the individual variable resistors.

Figure 6:
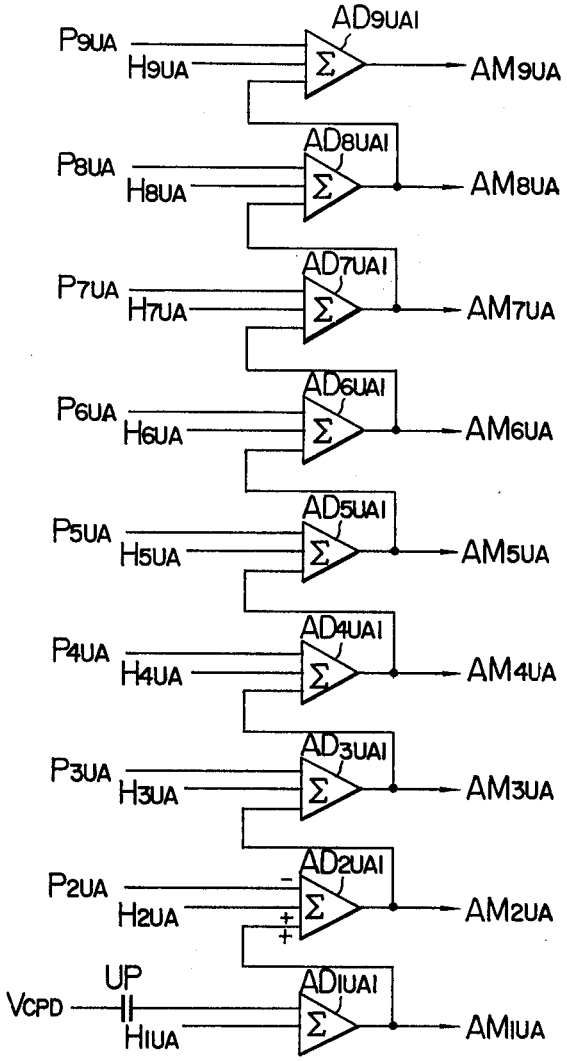

The signals P2UA to P1OUA and P1DA to P9DA representative of the number of in-car passengers classified by their target floors are applied to a circuit shown in FIG. 6.

Figure 5:
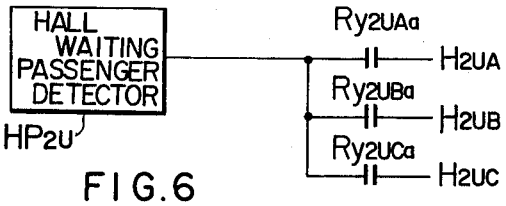

FIG. 5 shows one form of a circuit disposed in the hall of, for example, second floor for computing the number of passengers waiting in the hall of the second floor by registering an up hall call. The output signals of the circuit shown in FIG. 5 are also applied to FIG. 6.

A hall waiting passenger detector HP2U in the circuit shown in FIG. 5 may be anyone of various forms as described below.

(1) A plurality of mat switches each having a size corresponding to the unit floor area (of, for example, 60 cm × 40 cm) occupied by one passenger are disposed at the landing of each floor so as to detect the number of waiting passengers on the basis of the number of such mat switches which are energized. (Such mat switch is disclosed in, for example, Japanese Laid-Open (Kokai) Specification No. 50-58740.)

(2) A plurality of ultrasonic wave transmitters and receivers are mounted on the ceiling or side walls of the hall adjacent to the landing of each floor so as to detect the number of persons present in the hall thereby detecting the number of waiting passengers on the basis of the amount of reflected waves. Such passenger detecting devices are disclosed in, for example, Japanese Laid-Open (Kokai) Specification Nos. 51-35373, 51-379, 51-380 and 51-23177.

(3) An industrial television camera is disposed in the hall adjacent to the landing of each floor so as to detect the number of waiting passengers on the basis of the state of the output or variations in the picture elements of the camera.

Referring to FIG. 5 again, the hall waiting passenger detector HP2U, which may be composed of mat switches, delivers output signals H2UA, H2UB and H2UC representative of the number of hall waiting passengers. Since an up hall call is originated from the second floor, one of service relays R*y*2UA, R*y*2UB and R*y*2UC determined by circuits 13 and 14 described later is energized, and the corresponding signal H2UA, H2UB or H2UC is applied through the corresponding one of relay contacts $Ry2UA_a$, $Ry2UB_a$ and $Ry2UC_a$ to a circuit shown in FIG. 6.

FIG. 6 shows a circuit for forecasting the number of in-car passengers at each of the successive floors so as to determine whether or not the elevator car A instructed to move upward can service these floors. It is apparent that a circuit similar to that shown in FIG. 6 is provided for the elevator car A to operate during downward movement thereof, and similar circuits are also provided for the elevator cars B and C.

Referring to FIG. 6, the voltage signal $V_{CPD}$ representative of the number of in-car passengers is applied from the circuit shown in FIG. 4 to an adder AD1UA1 through a contact up which is turned on when elevator car A moves upward. The signal H1UA representative of the number of passengers waiting in the hall of the first floor is also applied to this adder AD1UA1. The output of the adder AD1UA1 is applied to another adder AD2UA1. It will be understood from reference to FIG. 5 that, in this case, the signal H1UA representative of the number passengers waiting in the hall of the first floor is not applied unless the elevator car A is decided to service an up hall call originated from the first floor. It is therefore apparent that this signal H1UA is applied to the adder AD1UA1 only when the elevator car A is located at the first floor (provided that the building has no basement) and responds to an up hall call originated from the first floor. At this time, the output $V_{CPD}$ of the in-car passenger detector CPD will be a "0". In other words, the output of the adder AD-1UA1 appearing in response to the application of the signal H1UA represents the number of passengers present in the elevator car A when this elevator car A dispatches the first floor. Of course, the signal H1UA does not appear when no up hall call is originated from the first floor or when the elevator car A does not service an up hall originated from the first floor even if such up hall call were originated. In this case, the output of the adder AD1UA1 is nil, that is, the number of in-car passengers is zero when the elevator car A dispatches the first floor.

The adder AD2UA1 computes the number of passengers in the elevator car A when the elevator car A dispatches the second floor. To this end, the number of passengers getting off at the second floor must be subtracted from and the number of passengers getting on at the second floor must be added to the number of passengers present in the elevator car A (the output of the adder AD1UA1) before it arrives at the second floor. The number of passengers getting off at the second floor is already known from the number of in-car passengers classified by their target floors, which has been described with reference to FIG. 4. The signal P2UA representative of the number of in-car passengers, whose target floor is the second floor, is a negative voltage signal. Thus, the number of in-car passengers whose target floor is the second floor is subtracted from the number of passengers present in the elevator car A. The number of forecast passengers who will get on the elevator car A at the second floor is detected by the hall waiting passenger detector HP2U in the circuit shown in FIG. 5. The signal H2UA representative of the number of forecast passengers getting on at the second floor is applied to the circuit shown in FIG. 6 through the contact $Ry2UA_a$ of service relay R*y*2UA when the elevator car A is selected to service the up hall call originated from the second floor. This signal H2UA is applied to the adder AD2UA1, and thus, the output of this adder AD2UA1 represents the number of forecast in-car passengers when the elevator car A dispatches the second floor. In this manner, the number of forecast in-car passengers at each of the successive floors is detected.

The number of forecast passengers getting off at a target floor registered in the elevator car is thus subtracted from the number of in-car passengers only when such target floor is designated, and the number of passengers waiting in the hall of a floor is added to the number of in-car passengers only when the elevator car is selected to respond to the hall call originated from this floor. It is therefore possible to forecast the number of in-car passengers at the time of dispatch regardless of the location of the elevator car. It is apparent that a circuit arrangement entirely similar to that shown in FIG. 6 can be used to deal with downward movement of the elevator car. In such a case, the signal $V_{CPD}$ is applied through a contact DN which is turned on when the elevator car move downward.

Figure 7:
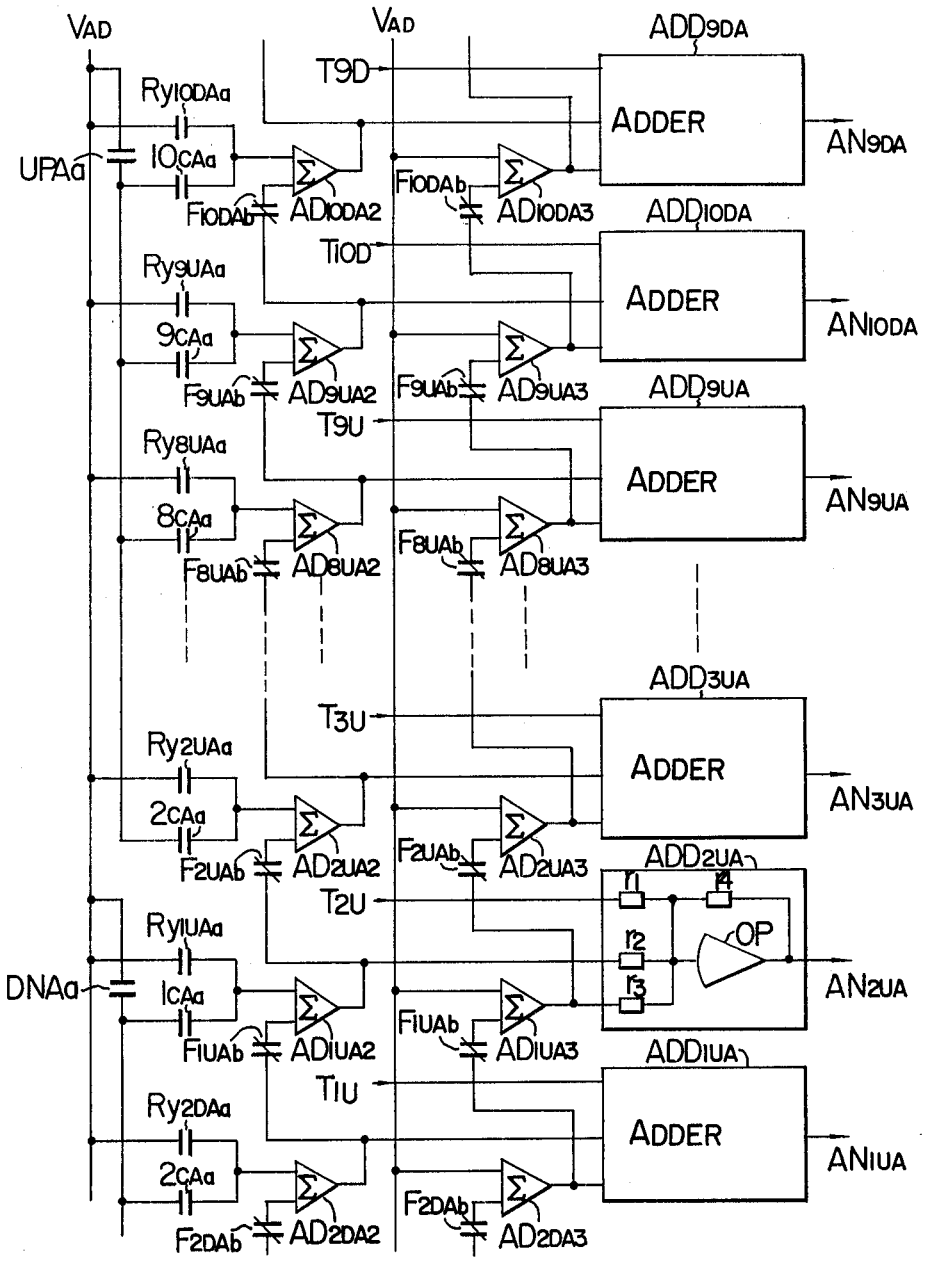

FIG. 7 shows a circuit for computing the forecast waiting time at each of the successive floors when the elevator car A moves upward. It is apparent that a circuit similar to that shown in FIG. 7 is also provided for the elevator car A to operate during the downward movement of the elevator car A, and similar circuits are also provided for the elevator cars B and C.

Suppose, for example, that the elevator car A is located at the first floor for upward movement. Then, a relay contact $F1UA_b$ is in a position. A predetermined voltage $V_{AD}$ corresponding to a length of time required for the elevator car A to run one floor interval passes through the route of $V_{AD}$-AD1UA3-$F2UA_b$-AD2UA3 . . . . The output of the adder AD1UA3 has a voltage level corresponding to the length of time required for the elevator car A to run one floor interval. This adder output signal is applied to adders ADD2UA and AD-2UA3. The output of the adder AD2UA3 has a voltage level corresponding to the length of time required for the elevator car A to run two floor intervals. In this manner, the floor intervals between the present location of the elevator car A and the individual floors are computed to be applied to associated adders.

Suppose, then, that a car call for the eighth floor is registered in the elevator car A and an up hall call originated from the second floor is allotted to the elevator car A. The predetermined voltage $V_{AD}$ passes through the route of $V_{AD}$-$Ry2UA_a$-AD2UA2-$F8UA_b$-AD8UA2 . . . . The output of each of the adders AD-2UA2 to AD7UA2 has a voltage level corresponding to the length of time required for the elevator car A to stop at one of the floors. On the other hand, the output of the adder AD8UA2 has a voltage signal corresponding to the length of time required for the elevator car A to stop at two of the floors, due to the fact that the voltage $V_{AD}$ is applied by the route of $V_{AD}$-$UPA_a$-$8CA_a$ to this adder AD8UA2 in addition to the output of the adder AD7UA2. These adder output signals are applied to adders ADD2UA to ADD9UA. These adder outputs represent respectively the forecast waiting times at the third to seventh floors from which no hall calls are originated and which have two to six floor intervals from the position of the elevator car A. The adders ADD2UA to ADD9UA deliver outputs representative of the length of time required for the elevator car A to service the corresponding floors when operational resistors $r_2$ to $r_4$ in each of these adders are suitably adjusted although those in the adder ADD2UA are only shown in FIG. 7. For example, the length of time required for the elevator car to stop at one of the floors and the length of time required for the elevator car to run one floor interval are assumed to be about 10 seconds and about 2 seconds respectively as described hereinbefore when the length of time required for the acceleration and deceleration from the rated speed, the length of time required for the opening and closing of the door, the length of time required for the passengers to get off and on the elevator car, and other necessary factors are taken into account. In this manner, the forecast waiting time at each of the third to seventh floors can be computed.

Figure 8:
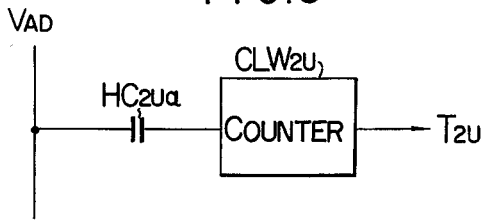

In regard to the second floor originating the up hall call allotted to the elevator car A, the length of time elapsed after the origination of this up hall call is counted by a counter CLW2U as shown in FIG. 8, and the counter output T2U is applied to the adder ADD-2UA in FIG. 7 to be added to the forecast waiting time at the second floor originating the up hall call.

In the manner above described, the forecast waiting time, that is, the length of time required for completing the elevator service is computed for all the calls including hall calls which will be registered and allotted to the elevator car A and hall calls allotted already to the elevator car A.

Figure 9:
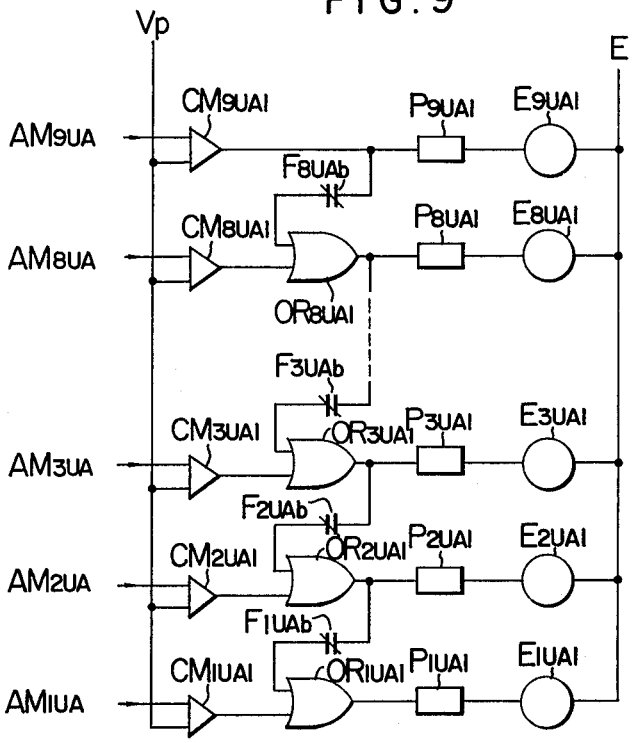

FIG. 9 shows a circuit for determining the serviceability of the elevator car A on the basis of the detected number of forecast in-car passengers classified by their target floors when the elevator car A moves upward. It is apparent that a circuit similar to that shown in FIG. 9 is also provided to operate during the downward movement of the elevator car A, and similar circuits are also provided for the elevator cars B and C.

Referring to FIG. 9, a reference voltage $V_P$ is used to detect the service state of the elevator car A and may be set at a level corresponding to the loading capacity. This reference voltage $V_P$ is applied to comparators CM1UA1 to CM9UA1. Outputs of "1" level appear from these comparators CM1UA1 to CM9UA1 only when input signals AM1UA to AM9UA have a level higher than the reference voltage $V_P$. In the reverse case, these comparator outputs are of "0" level.

Suppose, for example, that the elevator car A is located at the first floor for upward movement, and the forecast in-car passengers will exceed the loading capacity when the elevator car A responds to an up hall call originated from the third floor. The voltage signal AM3UA having a level proportional to the number of forecast in-car passengers at the third floor when the elevator car A responds to the up hall call originated from the third floor is applied from the circuit shown in FIG. 6 to the comparator CM3UA1 in FIG. 9 to be compared with the reference voltage $V_P$, and an output of "1" level appears from this comparator CM3UA1. This comparator output is applied through an OR gate OR3UA1 to an amplifier P3UA1, and the amplifier output energizes a relay E3UA1. The output of the OR gate OR3UA1 is also applied through a relay contact $F2UA_b$, another OR gate OR2UA1 and another amplifier P2UA1 to another relay E2UA1 to energize the same. Another relay E1UA1 is similarly energized. The remaining relays are not energized. This means that the elevator car A is impossible to service the up hall call originated from the third floor in addition to up hall calls which may be originated from the first and second floors.

Figure 10:
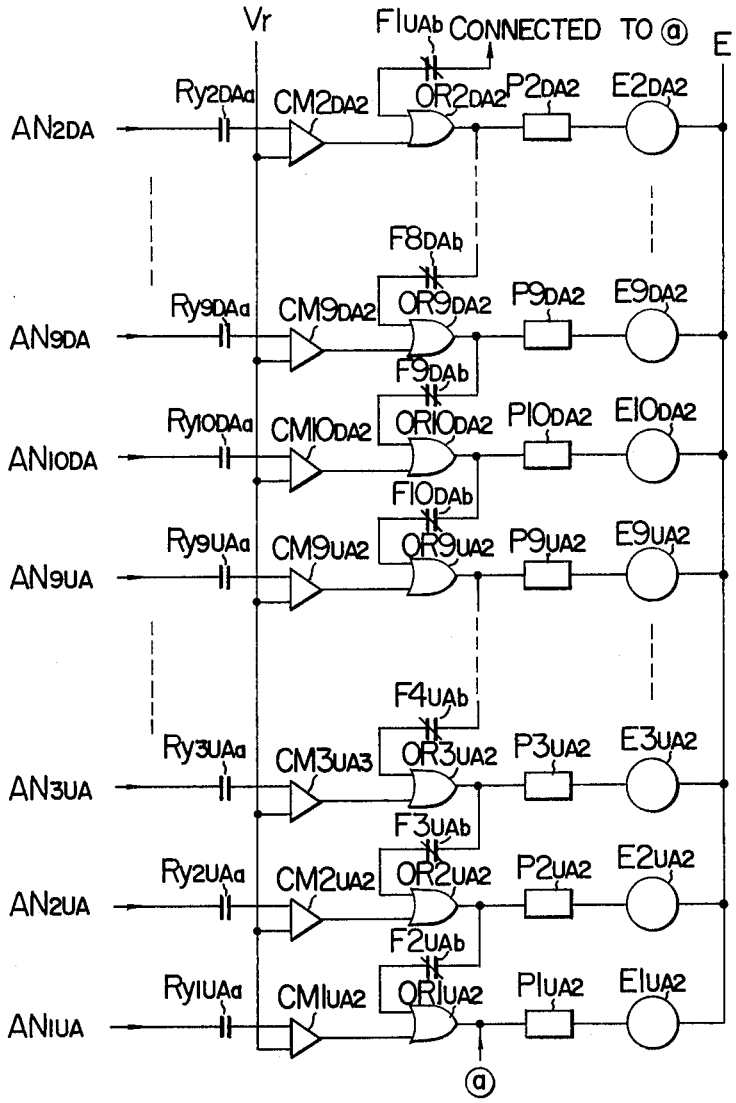

FIG. 10 shows a circuit for determining the serviceability of the elevator car A for an already allotted hall call on the basis of the forecast waiting time computed by the circuit shown in FIG. 7 when the elevator car A moves upward. It is apparent that a circuit similar to that shown in FIG. 10 is also provided to operate during the downward movement of the elevator car A, and similar circuits are also provided for the elevator cars B and C.

Suppose, for example, an up hall call originated from the third floor is allotted to the elevator car A situated at the first floor for upward movement, and the forecast waiting time at the third floor exceeds a predetermined limit when the elevator car A responds to such up hall call. A relay contact $Ry3UA_a$ is turned on, and the voltage signal AN3UA having a level proportional to the forecast waiting time at the third floor when the elevator car A responds to the up hall call originated from the third floor is applied from the circuit shown in FIG. 7 to a comparator CM3UA2 in FIG. 10 through the relay contact $Ry3UA_a$ to be compared with a reference voltage $Vr$ having a level corresponding to the predetermined waiting time limit. An output of "1" level appears from this comparator CM3UA2. This comparator output is applied through an OR gate OR3UA2 to an amplifier P3UA2, and the amplifier output is applied to a relay E3UA2 to energize the same. Relays E2UA2 and E1UA2 are also energized as in the circuit shown in FIG. 9. This means that the elevator car A is impossible to service the up hall call originated from the third floor in addition to up hall calls which may be originated from the first and second floors.

Figure 11:
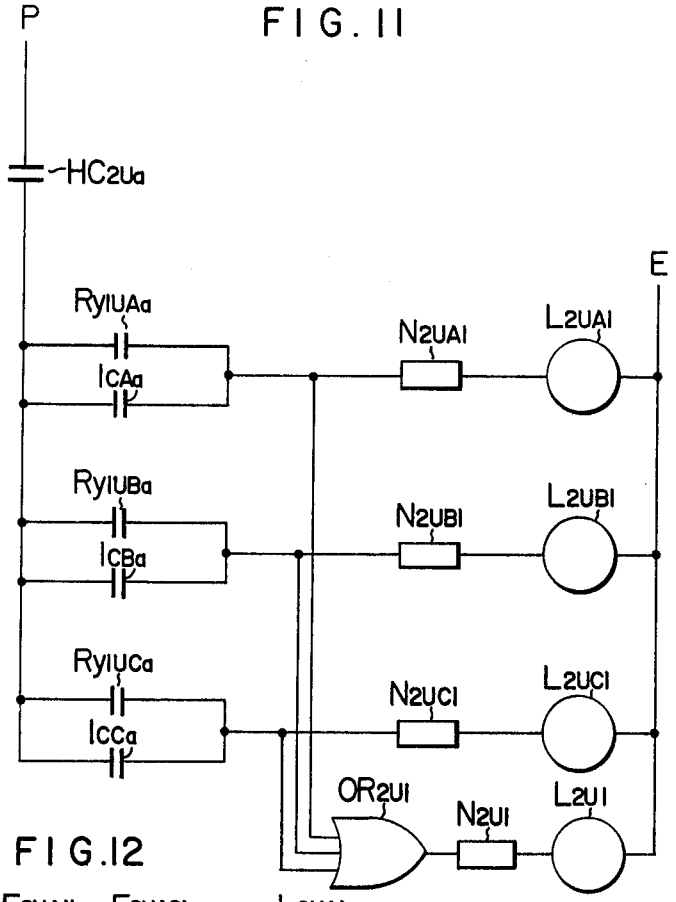
Figure 12:
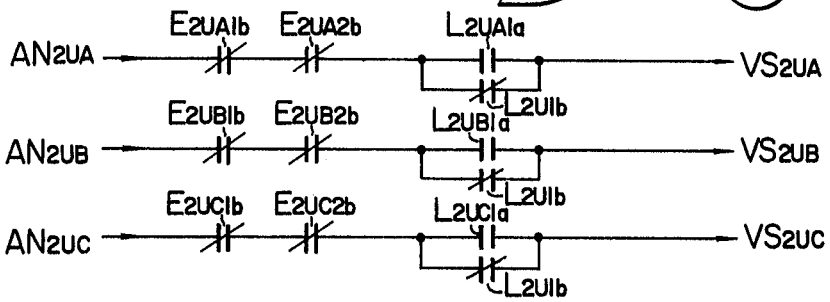

FIGS. 11 and 12 show a circuit for detecting an elevator car having already instructed stopping floors within a predetermined floor range contiguous to a new up hall call originating floor, and a circuit for detecting an elevator car capable of servicing such new up hall call, respectively. These circuits are principal features of the first embodiment of the present invention. These circuits are provided for the second floor to operate during the upward movement of the elevator cars A, B and C. It is apparent that circuits similar to those shown in FIGS. 11 and 12 are also provided to operate during the downward movement of the elevator cars, and similar circuits are provided for each of the floors.

Suppose now that a new up hall call is originated from the second floor. Then, a relay contact $HC2U_a$ of relay HC2U is turned on in FIG. 11. A voltage signal P is applied to relay contacts $Ry1UA_a$ to $Ry1UC_a$ of allotment relays energized in response to the origination of an up hall call from the first floor to allot this up hall call to the elevator cars A, B and C. This voltage signal P is also applied to contacts $1CA_a$ to $1CC_a$ of car call buttons for the first floor in the elevator cars. Suppose, for example, that the up hall call originated from the first floor is allotted to the elevator car A, and neither hall calls nor car calls are allotted or registered in the elevator cars B and C. Then, the relay contact $Ry1UA_a$ is solely turned on, and the voltage P is supplied through an amplifier N2UA1 to a relay L2UA1 to energize the same. This voltage P is also applied through the relay contact $Ry1UA_a$ to an OR gate OR2U1. An output of "1" level appears from the OR gate OR2U1 to be applied through another amplifier N2U1 to another relay L2U1 to energize the same.

Figure 13:
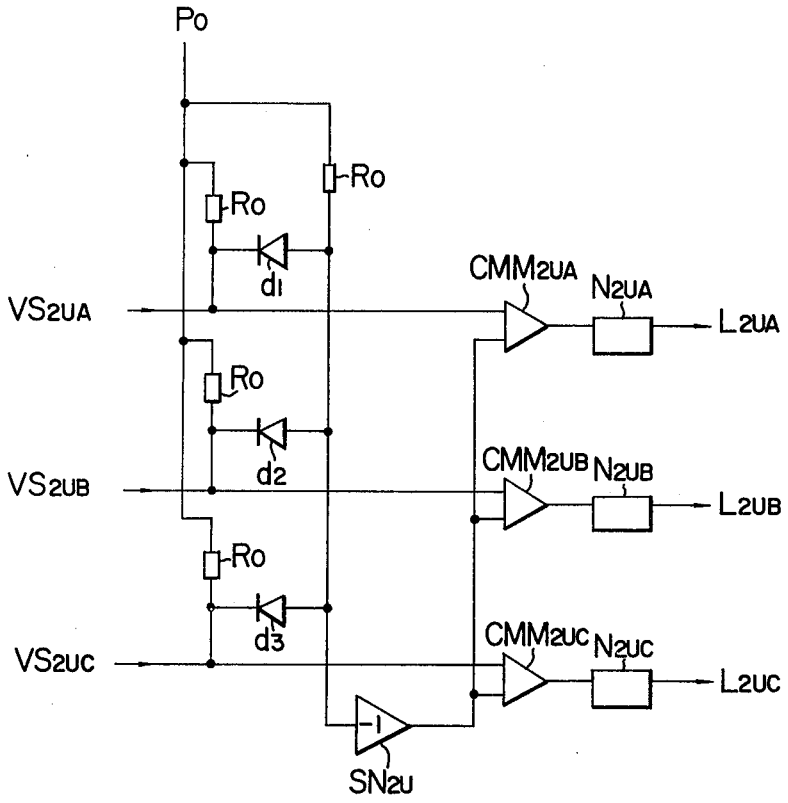

In the meantime, the voltage signals AN2UA, AN2UB and AN2UC representative of the forecast waiting times at the second floor originating the new up hall call are applied from the circuit shown in FIG. 7 to relay contacts $E2UA1_b$ to $E2UCl_b$ and $E2UA2_b$ to $E2UC2_b$ of relays E2UA1 to E2UC1 and E2UA2 and E2UC2 in FIG. 11 which determines the serviceability of the elevator cars A, B and C. When the elevator car A is determined serviceable, the relay contacts $E2UA1_b$ and $E2UA2_b$ are turned on. The voltage signal AN2UA representative of the forecast waiting time at the second floor when serviced by the elevator car A appears as an output signal VS2UA from FIG. 12 due to the fact that the relay contacts $L2UA1_a$ and $L2UA1_b$ are turned on and off respectively. On the other hand, no output signals VS2UB and VS2UC associated with the elevator cars B and C appear from the circuit shown in FIG. 12 due to the fact that the relay contacts $L2UB1_a$ and $L2UC1_a$ are turned off. The signal VS2UA is applied to a minimum selection circuit shown in FIG. 13 as described later, and the corresponding output of the circuit shown in FIG. 13 is applied to an allotment circuit shown in FIG. 14 as described later to turn on a relay $Ry2UA$. Thus, the new up hall call originated from the second floor is allotted to the elevator car A.

Consider, then, the case in which an up hall call originated from the first floor is allotted already to the elevator car A when the new up hall call is originated from the second floor, and a car call for the first floor is registered in the elevator car B. Due to the allotment of the up hall call from the first floor to the elevator car A already, the relay contact $Ry1UA_a$ is turned on in FIG. 11, and the relay L2UA1 is energized by the output of the amplifier N2UA1. Further, due to the registration of the car call for the first floor in the elevator car B, the relay contact $1CB_a$ is turned on, and the relay L2UB1 is also energized. The relay L2UC1 is not energized since no call demanding stopping at the first floor is allotted to or registered in the elevator car C. The relay L2U1 is also energized. In such a state, the outputs VS2UA and VS2UB corresponding to the voltage signals AN2UA and AN2UB representative of the forecast waiting times associated with the elevator cars A and B appear from the circuit shown in FIG. 12. This means that the elevator cars A and B are decided to be capable of servicing the new up hall call originated from the predetermined floor range, and the signals VS2UA and VS2UB representative of the forecast waiting times at the second floor when serviced by the elevator cars A and B appear from the circuit shown in FIG. 12.

None of the relays L2UA1, L2UB1 and L2UC1 are energized when none of the elevator cars A, B and C have stop-demanding calls allotted thereto within the predetermined floor range. In such a case, however, all the relay contacts $L2U1_b$ are turned on in FIG. 12 since the relay L2U1 is not energized. Therefore, all the signals AN2UA, AN2UB and AN2UC representative of the forecast waiting times associated with the elevator cars A, B and C appear as the output signals VS2UA, VS2UB and VS2UC of the circuit shown in FIG. 12.

In the manner above described, the circuit shown in FIG. 11 detects the elevator car or cars having an already allotted or registered call demanding stopping at the floor which lies backward of the floor originating a new hall call. When the elevator car or cars detected by the circuit shown in FIG. 11 are capable of servicing the new hall call, the circuit shown in FIG. 12 delivers an output signal or signals representative of the forecast waiting time or times associated with the elevator car or cars. When none of such elevator cars are detected, all the output signals VS2UA, VS2UB and VS2UC representative of the forecast waiting times are delivered from the circuit shown in FIG. 12 as all the elevator cars can service the new up hall call.

FIG. 13 shows a circuit for selecting an elevator car which provides a minimum forecast waiting time in response to the application of the output signals VS2UA, VS2UB and VS2UC of the circuit shown in FIG. 12. The circuit shown in FIG. 13 is provided for the second floor to operate when the elevator cars move upward. It is apparent that a circuit similar to that shown in FIG. 13 is provided for the downward movement, and similar circuits are also provided for the remaining floors. This minimum selection circuit is described in detail in Japanese Patent Publication No. 11938/72 and is known per se. The operation of this circuit will therefore be briefly described.

Suppose, for example, that the inputs VS2UA, VS2UB and VS2UC to this minimum selection circuit have voltage levels of 1 volt, 2 volts and 3 volts respectively, and the forward voltage drop of diodes $d_1$, $d_2$ and $d_3$ is 0.5 volts. Then, current flows through the route of $P_0$-$R_0$-$d_1$-VS2UA, and the diode $d_1$ solely conducts. An anode potential of 1.5 volts appears at the common-connected diodes. An output voltage of $-1.5$ volts appears from a sign inverter SN2U to be applied to comparators CMM2UA, CMM2UB and CMM2UC. The inputs to these comparators CMM2UA, CMM2UB and CMM2UC are given respectively by $1 + (-1.5) = -0.5$ volts, $2 + (-1.5) = 0.5$ volts, and $3 + (-1.5) = 1.5$ volts. Thus, an output signal of "0" level appears only from the comparator CMM2UA to be applied to a NOT gate N2UA, and an output signal L2UA of "1" level appears from this NOT gate N2UA. In this manner, the input having the minimum level is selected from among all the inputs, and the signal associated with the corresponding elevator car appears from the circuit shown in FIG. 13. When, for example, the relays E2UA1 and E2UA2 in FIGS. 9 and 10 are energized to turn off the relay contacts $E2UA1_b$ and $E2UA2_b$ in FIG. 12, and the voltage signal VS2UA disappears, the power supply voltage is applied to the cathode of the diodes to prevent erroneous operation of the minimum selection circuit.

In the manner above described, the output having the minimum voltage level is selected from among the outputs VS2UA, VS2UB and VS2UC of the circuit shown in FIG. 12. In other words, the elevator car is selected which can arrive at the new hall call originating floor earliest of all after the minimum forecast waiting time. The corresponding output signal L2UA, L2UB or L2UC appearing from the circuit shown in FIG. 13 as the result of the service elevator car selection is applied to a new hall call allotment circuit shown in FIG. 14.

Figure 14:
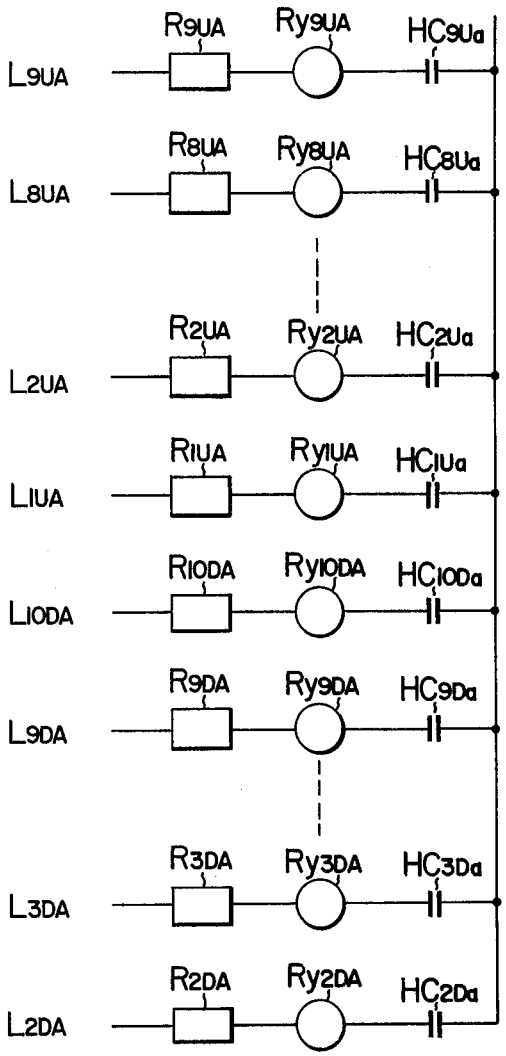

The new hall call allotment circuit shown in FIG. 14 is provided for the elevator car A, and it is apparent that similar circuits are also provided for the elevator cars B and C. Suppose, for example, that the signal L2UA is applied to the circuit shown in FIG. 14 due to the selection of the elevator car A as the car for responding to a new up hall call originated from the second floor. Then, the signal L2UA is amplified by an amplifier R2UA to energize a hall call allotment relay R*y*2UA through a contact $HC2U_a$ which is turned on in response to the origination of the new up hall call from the second floor. In this manner, in response to the application of anyone of service elevator car selection signals L1UA to L9UA and L2DA to L10DA to the corresponding one of amplifiers R1UA to R9UA and R2DA to R10DA, the corresponding one of allotment relays R*y*1UA to R*y*9UA and R*y*2DA to R*y*10DA is energized to allot the corresponding hall call to the elevator car A.

Suppose, for example, that a new up hall call apears from the second floor to turn on the contact $HC2U_a$ as described, and the signals VS2UA and VS2UB appear from the circuit shown in FIG. 12. These signals VS2UA and VS2UB are applied to the circuit shown in FIG. 13 so that the elevator car can be selected which is associated with the signal of lower voltage level. When now the signal VS2UA associated with the elevator car A has a lower voltage level than the signal VS2UB associated with the elevator car B, the service elevator car selection signal L2UA is applied from the circuit shown in FIG. 13 to the circuit shown in FIG. 14. In the circuit shown in FIG. 14, the contact $HC2U_a$ is turned on in response to the origination of the new up hall call from the second floor. Thus, the allotment relay R*y*2UA is energized to allot the new up hall call from the second floor to the elevator car A.

When none of the elevator cars have stop-demanding calls allotted thereto within the predetermined floor range contiguous to the second floor originating the new up hall call, all the relays L2UA1, L2UB1, L2UC1 and L2U1 in FIG. 11 are not energized. Therefore, all the output signals VS2UA, VS2UB and VS2UC appear from the circuit shown in FIG. 12 to be applied to the circuit shown in FIG. 13. The circuit shown in FIG. 13 selects the elevator car which can arrive at the second floor earliest of all, and the corresponding one of the service elevator car selection signals L2UA, L2UB and L2UC is applied to the circuit shown in FIG. 14. The new up hall call originated from the second floor is allotted to the selected elevator car in a manner similar to that above described.

It will be understood from the above description that, according to the first embodiment of the present invention, a new hall call originated from one of the floors is allotted preferentially to the elevator car having a stop-demanding call in the vicinity of the new hall call originating floor. The elevator cars can therefore efficiently service all the hall calls. Thus, trouble, for example, the bunched running occurred inevitably in the prior art systems can be completely obviated. According to the present invention, therefore, the individual elevator cars can be distributed in the entire floor range so as to provide uniform service for all the hall calls. It is therefore possible to make uniform and shorten the average waiting time at the individual floors and to minimize a long-waiting call.

In the first embodiment of the present invention, only one backward floor contiguous to the floor originating a new hall call is selected as a predetermined floor range, and the presence of an already allotted hall call or car call is detected as shown in FIG. 11 so as to avoid the bunched running. However, this predetermined floor range in the present invention is in no way limited to that above specified. This predetermined floor range may be suitably modified by limiting the call used as the basis of decision to a hall call or a car call. When, for example, the call used as the basis of decision is limited to a hall call, the car call relay contacts $1CA_a$ to $1CC_a$ in FIG. 11 are unnecessary. The effect of preventing the bunched running is greater when the call used as the basis of decision is limited to the hall call than when such call is limited to the car call. This is because the effect of control is greater in the case of the hall call than in the case of the car call, due to the fact that an elevator car responding to one hall call has generally a plurality of car calls registered therein.

Further, although the predetermined floor range is set to cover only one backward floor contiguous to a new hall call originating floor in the first embodiment of the present invention, the effect substantially similar to the above effect can be obtained even when one forward floor is selected in lieu of one backward floor. For example, in response to the origination of a new up hall call from the second floor, the presence of an already allotted or registered up hall call or car call may be detected for the floor or third floor lying forward contiguous to the second floor. The circuit arrangement for this purpose can be easily obtained by merely replacing the relay contacts $Ry1UA_a$ to $Ry1UC_a$ by the relay contacts $Ry3UA_a$ to $Ry3UC_a$ and replacing the relay contacts $1CA_a$ to $1CC_a$ by the relay contacts $3CA_a$ to $3CC_a$ in FIG. 11. In the case of this modification, however, the passengers waiting at, for example, the third floor may possibly wait a larger length of time due to the fact that a new up hall call originated from, for example, the second floor is allotted to the elevator car having the up hall call from the third floor allotted already thereto. It is therefore preferable to select the predetermined floor range so that it covers one backward floor (or a plurality of backward floors) contiguous to a new hall call originating floor.

Figure 15:
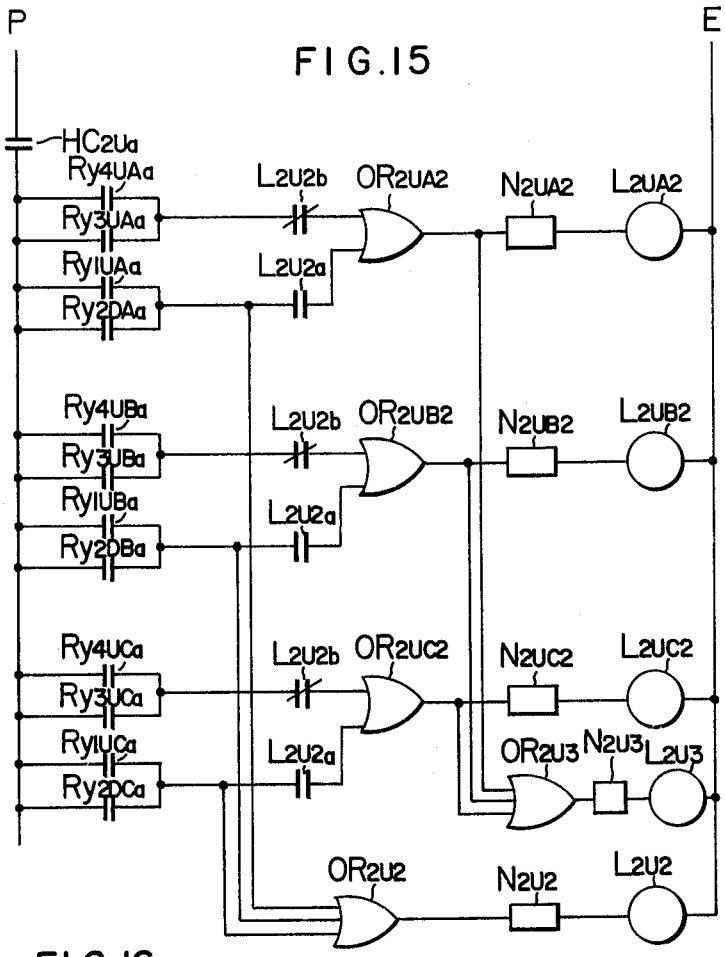
Figure 16:
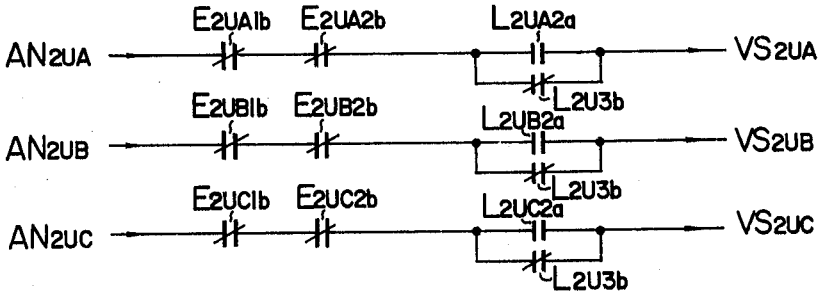

A modification will be described with reference to FIG. 15 in which the predetermined floor range is selected to cover a plurality of backward and forward floors. FIG. 15 shows a circuit provided to operate in response to an up hall call originated from the second floor. In FIG. 15, it is supposed that the predetermined floor range covers two backward floors and two forward floors contiguous to a new hall call originating floor. In FIG. 15, hall calls originated from the two backward floors have priority over those from the two forward floors, and hall calls originated from the predetermined floor range are only taken into account.

Thus, hall calls originated from the two backward floors contiguous to the second floor originating a new up hall call refer to an up hall call from the first floor and a down hall call from the second floor, while halls calls originated from the two forward floors contiguous to the second floor originating the new up hall call refer to an up hall call from the third floor and an up hall call from the fourth floor. Relay contacts $Ry1UA_a$ to $Ry1UC_a$, $Ry2DA_a$ to $Ry3UA_a$ to $Ry3UC_a$, and $Ry4UA_a$ to $Ry4UC_a$ are turned on respectively in response to the hall calls above described.

Suppose now that a down hall call originated from the second floor is allotted already to the elevator car A, and no hall calls are allotted to the elevator cars B and C. It is supposed further that all the elevator cars are serviceable. In response to the origination of a new up hall call from the second floor, the relay contact $HC2U_a$ is turned on. Since the down hall call from the second floor is allotted already to the elevator car A, the relay contact $Ry2DA_a$ is turned on to permit application of the voltage P to an OR gate OR2U2, and an output of "1" level appears from this OR gate OR2U2. This OR gate output signal is amplified by an amplifier N2U2 to energize a relay L2U2. Relay contacts of the energized relay L2U2 act to control the inputs to OR gates OR2UA2, OR2UB2 and OR2UC2 associated with the elevator cars A, B and C respectively. That is, hall call information of the floors lying backward relative to the new hall call originating floor are applied to these OR gates OR2UA2 to OR2UC2. The relay L2U2 is not energized when no hall calls are originated from the floors lying backward relative to the new hall call originating floor, that is, when such hall calls are not allotted to the individual elevator cars. In such a case, hall call information of the floors lying forward relative to the new hall call originating floor are applied to the OR gates OR2UA2 to OR2UC2.

Due to the fact that the relay contact $Ry2DA_a$ associated with to the backward floor is now turned on, the relay L2U2 is energized to turn on its contact $L2U2_a$, and an ouput of "1" level appears from the OR gate OR2UA2. The output of the OR gate OR2UA2 is applied through an amplifier N2UA2 to a relay L2UA2 to energize the same. The output of the OR gate OR2UA2 is also applied to another OR gate OR2U3, and the output of this OR gate OR2U3 is applied through another amplifier N2U3 to another relay L2U3 to energize the same. Therefore, the signal VS2UA associated with the elevator car A among the signals VS2UA to VS2UA appears from a circuit shown in FIG. 16 corresponding to the circuit shown in FIG. 12. The signals VS2UB and VS2UC associated with the elevator cars B and C respectively do not appear from the circuit shown in FIG. 16 since relays L2UB2 and L2UC2 are not energized. The signal VS2UA is applied through the minimum selection circuit shown in FIG. 13 to the allotment circuit shown in FIG. 14, so that the new up hall call originated from the second floor can be allotted to the elevator car A as described hereinbefore.

When there are no elevator cars having calls allotted thereto within the two floors backward of the new hall call originating floor, the output of the OR gate OR2U2 is of "0" level, and the relay L2U2 is not energized. Therefore, the inputs to the OR gates OR2UA2 to OR2UC2 are hall call information of the floors lying forward relative to the new hall call originating floor. Suppose, for example, that an up hall call originated from the fourth floor is allotted already to the elevator car C. Then, the relay contact $Ry4UC_a$ is turned on, and an output of "1" level appears from an OR gate OR2UC2 to energize a relay L2UC2. Thus, the new up hall call originated from the second floor is allotted to the elevator car C.

It will thus be seen that, in the modification shown in FIG. 15 in which the predetermined floor range is selected to cover a plurality of backward and forward floors contiguous to a new hall call originating floor, the presence of hall calls originated from the floors lying backward relative to the new hall originating floor and allotted already to the elevator cars is initially detected, and when such allotted hall calls exist, the new hall call is allotted to the elevator car which can service after a minimum forecast waiting time. When none of such allotted calls are detected within this backward floor range, the presence of hall calls originated from the floors lying forward relative to the new hall call originating floor and allotted already to the elevator cars is then detected. When such allotted hall calls exist within the forward floor range, the new hall call is allotted to the elevator car which can service after a minimum forecast waiting time. When such allotted hall calls do not exist, the new hall call is allotted to the elevator car which can arrive at the new hall call originating floor earliest of all. In this modification, the predetermined floor range is selected to cover a plurality of backward and forward floors. Thus, the effect of preventing the bunched running is greater than when the predetermined floor range includes only one backward or forward floor. However, this predetermined floor range should be suitably selected since one hall call after another may be allotted to a specific elevator car when the predetermined floor range is selected to include an excessively large number of floors.

Figure 17:
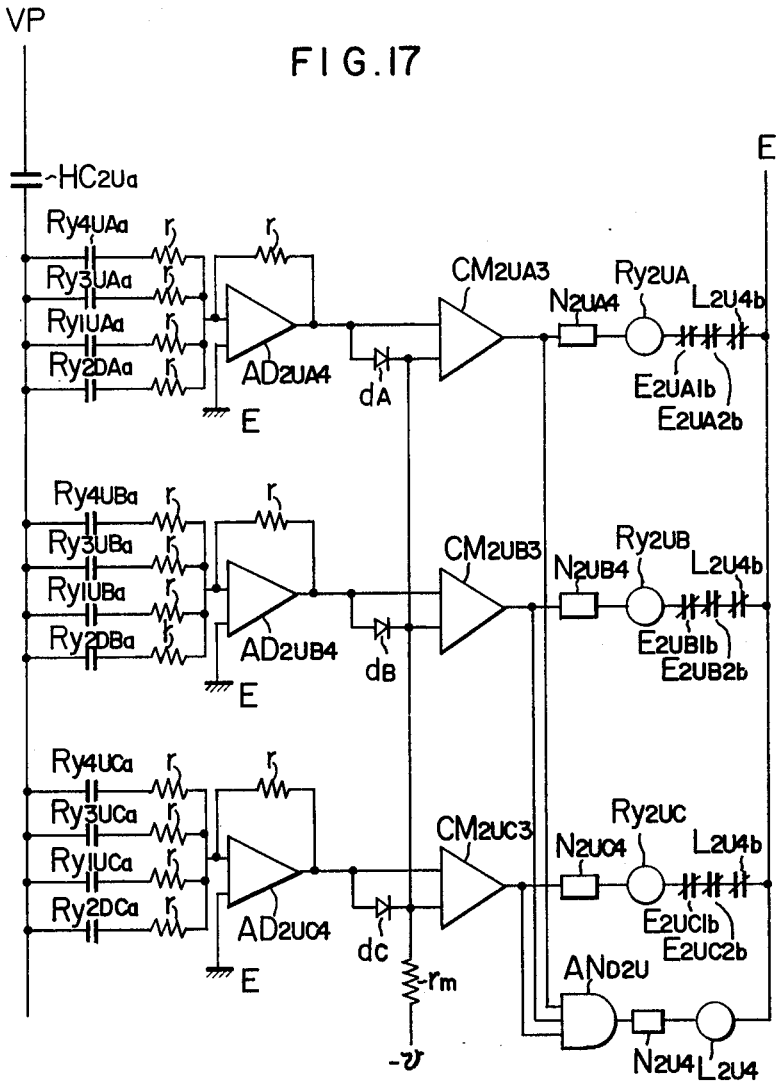
FIG. 17 shows a modification of the circuit shown in FIG. 15.

FIG. 17 shows a circuit which allots a new hall call to an elevator car having a greater number of stop-demanding calls than others within a predetermined floor range including a plurality of backward and forward floors contiguous to a new hall call originating floor. In FIG. 17, the predetermined floor range is selected to cover two backward floors and two forward floors contiguous to a new hall call originating floor, as in the case of FIG. 15.

Referring to FIG. 17, a resistor $r$ and an operational amplifier AD2UA4 constitute an adder. Thus, when a voltage signal $V_p$ of, for example, 1 volt is applied to the circuit and a relay contact $Ry2DA_a$ is solely turned on in the circuit, the operational amplifier AD2UA4 produces an output of 1 volt. This operational amplifier AD2UA4 produces an output of 4 volts when all of relay contacts $Ry1UA_a$, $Ry3UA_a$ and $Ry4UA_a$ are in the on state in addition to the relay contact $Ry2DA_a$. The operational amplifier AD2UA4 produces thus a greater output with the increase in the number of hall calls allotted already to the elevator car A within the predetermined floor range. It is apparent that the same applies to the elevator cars B and C. Diodes $d$A to $d$C and comparators CM2UA3 to CM2UC3 constitute a maximum detection circuit. More precisely, the diodes $d$A to $d$C are common-connected at the cathode thereof to be connected to a negative voltage source $-v$ through a resistor $rm$. Further, these diodes $d$A to $d$C are respectively connected at the cathode thereof to one input terminal of the comparators CM2UA3 to CM2UC3 which are respectively connected at the other input terminal thereof to the operational amplifiers AD2UA4 to AD2UC4.

Suppose, for example, that the outputs of the operational amplifiers AD2UA4, AD2UB4 and AD2UC4 are 4 volts, 2 volts and 1 volt respectively. Then, the cathode voltage of the diodes is given by $(4 - 0.5) = 3.5$ volts when the forward voltage drop is assumed to be 0.5 volts. In such a case, the output of the comparator CM2UA3 associated with the elevator car A is $(4 - 3.5) = 0.5$ volts which is positive, and that of the comparator CM2UB3 associated with the elevator car B is $(2 - 3.5) = 1.5$ volts which is negative, while that of the comparator CM2UC3 associated with the elevator car C is $(1 - 3.5) = 2.5$ volts which is also negative. Therefore, the output of the comparator CM2UA3 associated with the elevator car A is solely positive, and those of the comparators CM2UB3 and CM2UC3 associated with the elevator cars B and C are negative. This means that the elevator car A is detected as having the maximum number of hall calls allotted already thereto. Amplifiers N2UA4, N2UB4 and N2UC4 are adapted to amplify only a positive input thereto. Thus, a relay $Ry2UA$ associated with the elevator car A is energized by the output of the amplifier N2UA4, and a new up hall call originated from the second floor is allotted to the elevator car A.

The outputs of all the comparators CM2UA3 to CM2UC3 will be positive when no hall calls are allotted to the elevator cars A, B and C within the predetermined floor range, and all of the relays $Ry2UA$ to $Ry2UC$ will be energized. In order to avoid such a situation, the outputs of the comparators CM2UA3 to CM2UC3 are applied to an AND gate AND2U so as to energize a relay L2U4 when all of the three inputs to the AND gate AND2U are positive. Relay contacts L2U4$b$ of relay L2U4 are connected in series with the energizing coils of relays $Ry2UA$ to $Ry2UC$ to obviate simultaneous energization of these relays.

Although hall calls originated from the predetermined floor range and allotted already to the elevator cars are utilized as information for the allotment of a new hall call in the circuit shown in FIG. 17, the effect will be similar to that above described when car calls instead of the hall calls are utilized as such information. Also, the effect will be improved when both such hall calls and such car calls are utilized as the information.

In the circuits shown in FIGS. 15 and 17, the predetermined floor range is set to cover two backward floors and two forward floors contiguous to a new hall call originating floor. In some cases, however, better service may be provided when this predetermined floor range is set to cover one backward floor and two forward floors depending on the traffic demand pattern of the elevator system. In such a case, the relay contacts $Ry2DA_a$, $Ry2DB_a$ and $Ry2DC_a$ may be omitted or rendered inoperative in the circuits shown in FIGS. 15 and 17.

A second embodiment of the elevator control system according to the present invention will be described with reference to FIGS. 1, 2A and 18.

It is supposed that three elevator cars A, B and C are arranged for parallel operation and move upward for servicing a plurality of floors of a building having ten floors, and a new up hall call is originated from a $P$th floor. Forecast waiting times $Wt_A^P$, $Wt_B^P$ and $Wt_C^P$, that is, lengths of time required for the elevator cars A, B and C to arrive at the $P$th floor originating the new up hall call are computed, for example, as follows:

$$\left.\begin{aligned} Wt_A^P &= \chi(H_A + C_A + F_A) + \beta \cdot R_A \\ Wt_B^P &= \chi(H_B + C_B + F_B) + \beta \cdot R_B \\ Wt_C^P &= \chi(H_C + C_C + F_C) + \beta \cdot R_C \end{aligned}\right\} \quad (1)$$

where $H_A$, $H_B$, $H_C$: Number of already allotted hall calls between the $P$th floor and present location of the elevator cars A, B and C $C_A$, $C_B$, $C_C$: Number of already registered car calls between the $P$th floor and present location of the elevator cars A, B and C (when the same floor includes both an already allotted hall call and an already registered car call, such car call is excluded.)

$F_A$, $F_B$, $F_C$: Number of stop-demanding calls forecast to arise between the $P$th floor and present location of the elevator cars A, B and C $R_A$, $R_B$, $R_C$: Number of floors between the $P$th floor and present location of the elevator cars A, B and C $\alpha$: Length of time (for example, about 10 seconds) required for the elevator car to stop at one of the floors $\beta$: Length of time (for example, about 2 seconds) required for the elevator car to run one floor interval Times $T_A^P$, $T_B^P$ and $T_C^P$ which are a function of the number of stop-demanding calls originated already from a predetermined floor range covering a plurality of (for example, three) backward and forward floors contiguous to the $P$th floor originating the new up hall call are then computed, as follows:

$$\left.\begin{aligned} T_A^P &= k_1 \cdot N_A^{P\pm1} + k_2 \cdot N_A^{P\pm2} + k_3 \cdot N_A^{P\pm3} \\ T_B^P &= k_1 \cdot N_B^{P\pm1} + k_2 \cdot N_B^{P\pm2} + k_3 \cdot N_B^{P\pm3} \\ T_C^P &= k_1 \cdot N_C^{P\pm1} + k_2 \cdot N_C^{P\pm2} + k_3 \cdot N_C^{P\pm3} \end{aligned}\right\} \quad (2)$$

where $N_A^{P\pm1}$, $N_B^{P\pm1}$, $N_C^{P\pm1}$: Number of calls demanding stopping of the elevator cars A, B and C at the (P−1)th and (P+1)th floors, which does not include the new up hall call from the *P*th floor $N_A^{P\pm2}$, $N_B^{P\pm2}$, $N_C^{P\pm2}$: Number of calls demanding stopping of the elevator cars A, B and C at the (P−2)th and (P+2)th floors, except the new up hall call from the *P*th floor $N_A^{P\pm3}$, $N_B^{P\pm3}$, $N_C^{P\pm3}$: Number of calls demanding stopping of the elevator cars A, B and C at the (P−3)th and (P+3) the floors, except the new up hall call from the *P*th floor $k_1$: Weight coefficient of the (P±1)th floors $k_2$: Weight coefficient of the (P±2)th floors $k_3$: Weight coefficient of the (P±3)th floors It will be seen from the equation (2) that the values of $T_A^P$, $T_B^P$ and $T_C^P$ become greater when a greater number of allotted hall calls or registered car calls exist in the vicinity of the *P*th floor.

Finally, evaluated times (differences $W_A^P$, $W_B^P$ and $W_C^P$ used for selecting a most suitable elevator car are computed, as follows:

$$\left.\begin{aligned} W_A^P &= Wt_A^P - T_A^P \\ W_B^P &= Wt_B^P - T_B^P \\ W_C^P &= Wt_C^P - T_C^P \end{aligned}\right\} \quad (3)$$

Therefore, the elevator car satisfying the condition $$\text{Min}\ \{W_A^P, W_B^P, W_C^P\} \quad (4)$$

is selected as a most suitable one, and the new up hall call originated from the *P*th floor is allotted to the selected elevator car.

It will thus be seen that an elevator control system offering improved service can be provided which obviates the bunched running occurred inevitably in the prior art systems and which makes substantially uniform the average waiting time and minimizes long-waiting hall calls.

Figure 2A:
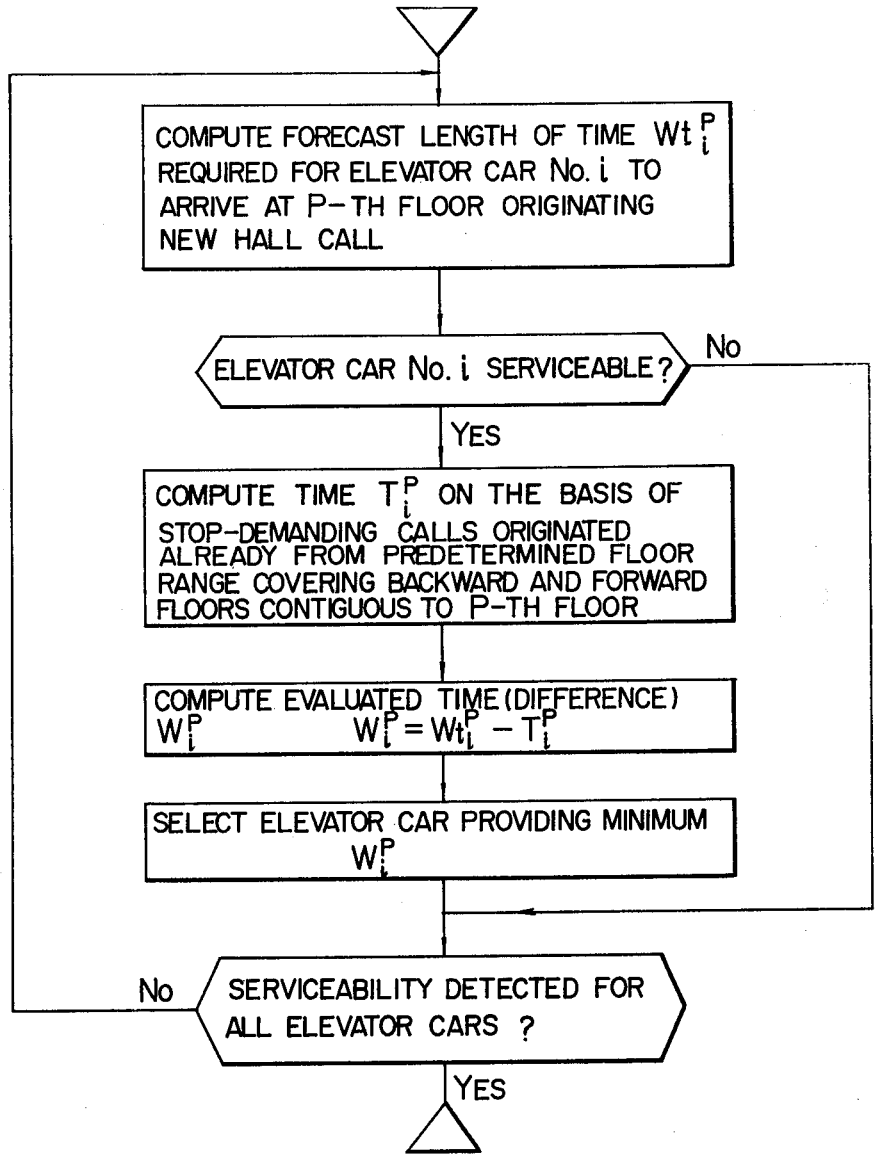
FIG. 2A is a flow chart illustrating the outline of the basic operation of the second embodiment of the present invention.

FIG. 2A is a flow chart illustrating the outline of the basic operation of the second embodiment of the present invention. In the first step, the length of time (the forecast waiting time) $Wt_i^P (i = 1, 2 \ldots n)$ required for an elevator car No. *i* to arrive at a *P*th floor originating a new up hall call is computed according to the equation (1). Then, the factors including the loaded condition and the waiting time are taken into account to determine the serviceability of the elevator car No. *i* for the *P*th floor. When this elevator car No. *i* is found non-serviceable, the same computation is carried out on another elevator car again. When this elevator car No. *i* is found serviceable, the time $t_i^P (i = 1, 2 \ldots n)$ is computed according to the equation (2).

The evaluated time $W_i^P (i = 1, 2 \ldots n)$ is computed for each of serviceable elevator cars according to the equation (3). The new up hall call originated from the *P*th floor is allotted to the elevator car which provides a minimum evaluated time $W_i^P$ among the computed values.

The above manner of hall call allotment will be described in more detail with reference to FIG. 1 again.

It is supposed that the predetermined floor range covers two backward floors and two forward floors contiguous to a floor originating a new hall call, and the weight coefficients $k_1$ and $k_2$ in the equation (2) are 5 and 2 respectively.

Referring to FIG. 1, a new up hall call is originated from the sixth floor. The elevator cars A, B and C are forecast to arrive at the sixth floor with the following lengths of time before the new up hall call is originated from the sixth floor:

$$Wt_A^6 = 18 \text{ seconds}$$

$$Wt_B^6 = 16 \text{ seconds}$$

$$Wt_C^6 = 44 \text{ seconds}$$

where stop-demanding calls forecast to arise thereafter are not taken into account.

Consider now stop-demanding calls at the two backward floors and two forward floors contiguous to the sixth floor originating the new up hall call. In the case of the elevator car A, an up hall call originated from the (6−1)th = 5th floor is allotted already thereto, and a car call for the (6+1)th = 7th floor is registered already therein, while no stop-demanding calls exist at the (6−2)th = 4th floor and the (6+2)th = 8th floor. In the case of the elevator car B, no stop-demanding calls exist at the (6−1)th = 5th floor and the (6+1)th = 7th floor, and a car call for the (6−2)th = 4th floor is registered already therein in addition to an up hall call originated already from the (6+2)th = 8th floor. In the case of the elevator car C, no stop-demanding calls exist within the predetermined floor range.

The times $T_A^6$, $T_B^6$ and $T_C^6$ are then computed according to the equation (2) on the basis of the already allotted and registered calls above described. The results are as follows:

$$T_A^6 = 5 \times 2 + 2 \times 0 = 10 \text{ seconds}$$

$$T_B^6 = 5 \times 0 + 2 \times 2 = 4 \text{ seconds}$$

$$T_C^6 = 5 \times 0 + 2 \times 0 = 0 \text{ second}$$

Then, the evaluated times (differences) $W_A^6$, $W_B^6$ and $W_C^6$ are computed according to the equation (3), as follows:

$$W_A^6 = Wt_A^6 - T_A^6 = 18 - 10 = 8 \text{ seconds}$$

$$W_B^6 = Wt_B^6 - T_B^6 = 16 - 4 = 12 \text{ seconds}$$

$$W_C^6 = Wt_C^6 - T_C^6 = 44 - 0 = 44 \text{ seconds}$$

Therefore, $W_A^6 = 8$ seconds is the minimum evaluated time satisfying the condition (4), and the new up hall call originated from the sixth floor is allotted to the elevator car A.

By virtue of such a manner of hall call allotment, the undesirable bunched running of the elevator cars A and B can be avoided, and the desired uniformity and shortening of the average waiting time at the individual floors and the desired minimization of long-waiting hall calls can be achieved to improve the elevator service.

The elevator control system embodying the second form of the present invention has a structure generally similar to that shown in FIG. 3. Thus, it comprises a circuit as shown in FIG. 4 for detecting the number of forecast in-car passengers classified by their target floors, a circuit as shown in FIG. 5 for computing the number of passengers waiting in the hall of each individual floor, and a circuit as shown in FIG. 6 for forecasting the number of in-car passengers at each of the successive floors. Similarly, circuits similar to those shown in FIGS. 7, 8, 9, 10, 13 and 14 described with reference to the first embodiment are also employed in the second embodiment, and the structure and operation of such circuits are also similar to those employed in the first embodiment.

Figure 18:
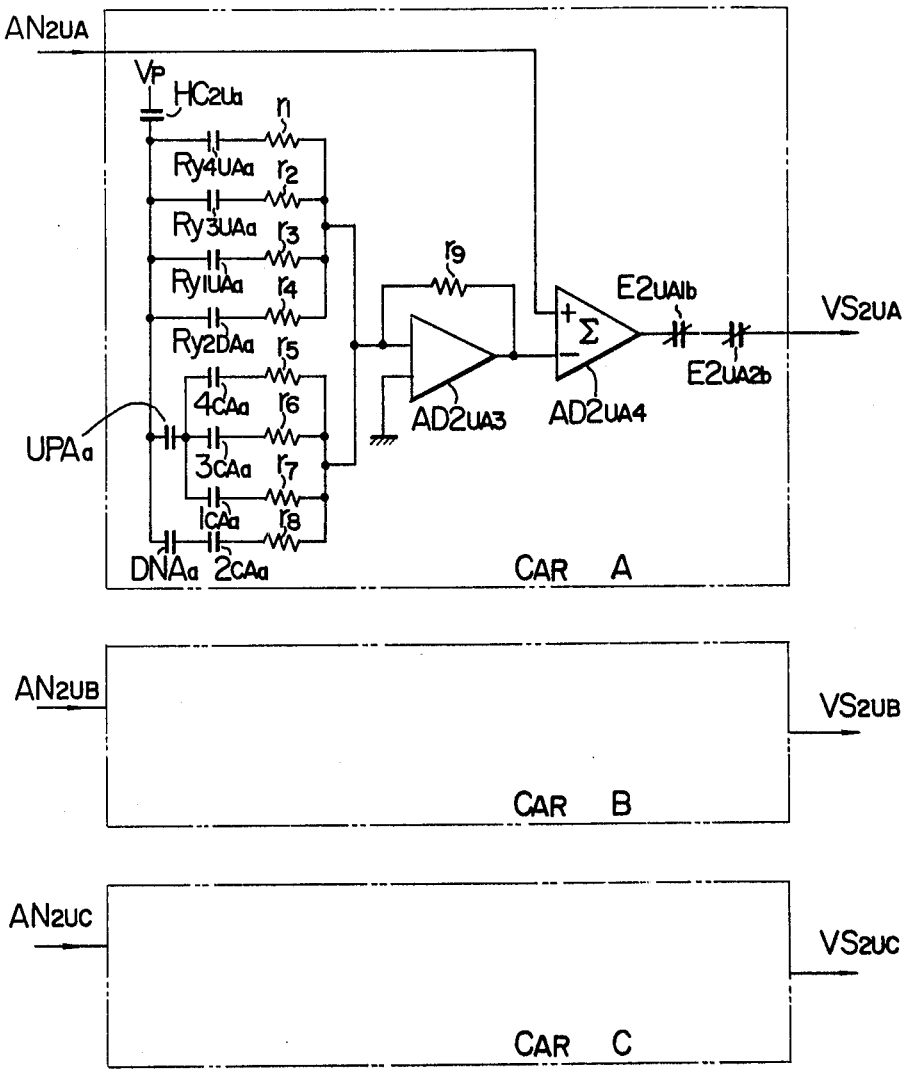
FIG. 18 is a circuit diagram of a circuit used in the second embodiment for preventing the bunched running of elevator cars.

The operation of the second embodiment of the present invention will now be described with reference to FIG. 18 showing a practical circuit structure.

FIG. 18 shows a circuit for preventing the bunched running of the elevator cars, and this circuit is one of the features of the second embodiment of the present invention. The circuit shown in FIG. 18 is provided at the second floor to operate in response to the origination of a new up hall call from the second floor when the elevator car A moves upward. It is apparent that a circuit similar to that shown in FIG. 18 is also provided to operate during the downward movement of the elevator car A, and similar circuits are also provided for the elevator cars B and C.

It is supposed again that the predetermined floor range is selected to cover two backward floors and two forward floors contiguous to a new hall call originating floor. In this case, a new up hall call is originated from the second floor. Thus, an up hall call originated from the first backward floor or first floor, an up hall call originated from the first forward floor or third floor, a down hall call originated from the second backward floor or second floor, and an up hall call originated from the second forward floor on fourth floor, are to be considered in this predetermined floor range.

Therefore, allotment relays R*y*2DA, R*y*1UA, R*y*3UA and R*y*4UA are energized in FIG. 14 in response to the origination of the hall calls above described. When the elevator car A is instructed to move upward, a contact $UPA_a$ is turned on. In this case, car call relays 1CA, 3CA and 4CA for the first, third and fourth floors are energized, while a car call relay 2CA is not energized since a contact $DNA_a$ is in the off state. On the other hand, when the elevator car A moves downward, the contact $DNA_a$ is turned on. In this latter case, the car call relay 2CA for the second floor is solely energized, while the car call relays 1CA, 3CA and 4CA are not energized.

A reference voltage $V_P$ is applied through the corresponding contacts and associated ones of resistors $r_1$ to $r_8$ to an operational amplifier AD2UA3 in FIG. 18. This operational amplifier AD2UA3 constitutes an adder together with another resistor $r_9$. The resistors $r_1$ to $r_8$ are suitably set at predetermined resistance values providing different weight coefficients depending on the floors or hall calls or car calls, and these weight coefficients correspond to $k_1$ to $k_2$ in the equation (2).

The output of the operational amplifier AD2UA3 provides one input to an adder AD2UA4 to which a voltage signal AN2UA representative of the forecast waiting time at the second floor is applied from the circuit shown in FIG. 7 as the other input. As a result, the difference between these voltage inputs appears from the adder AD2UA4. The output of this adder AD2UA4 passes through the relay contacts $E2UA1_b$ and $E2UA2_b$ of relays E2UA1 and E2UA2 shown in FIGS. 9 and 10 to appear as a voltage signal VS2UA representative of the evaluated time given by the equation (3). This voltage signal VS2UA does not appear when the relay contacts $E2UA1_b$ and $E2UA2_b$ are turned off, that is, when the elevator car A is decided non-serviceable.

Figure 1A:
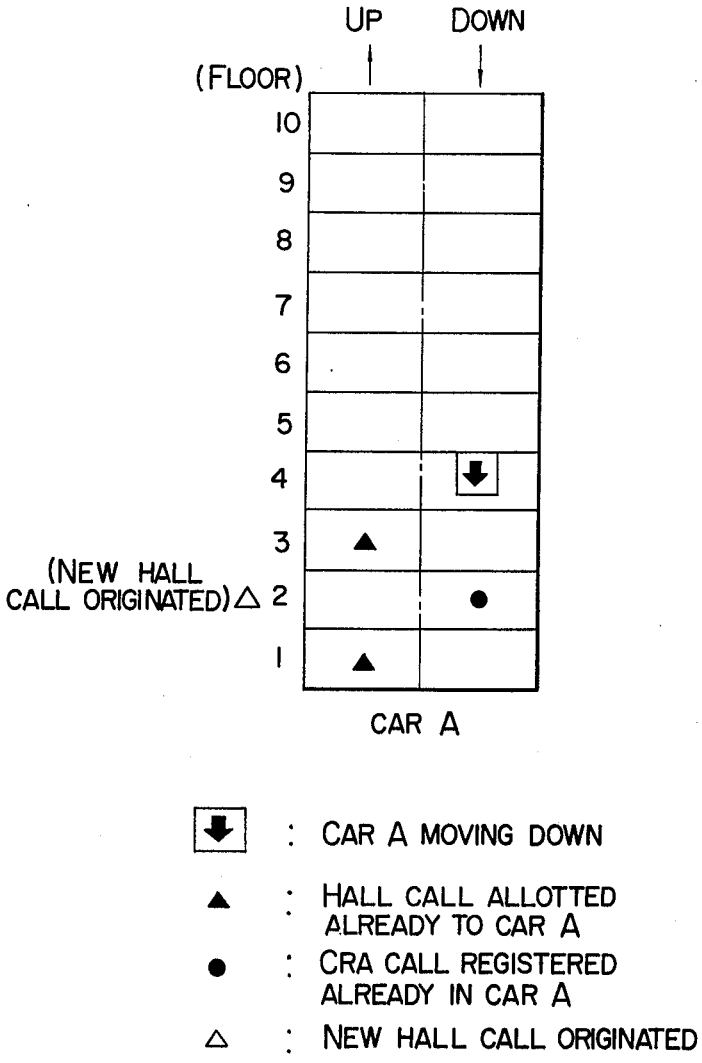
FIG. 1A is a diagrammatic view illustrating the operation of the circuit shown in FIG. 18.

The operation of the circuit shown in FIG. 18 will be described with reference to FIG. 1A. Referring to FIG. 1A, the elevator car A is shown located at the fourth floor for downward movement, with a car call for the second floor registered already therein and with up hall calls originated from the first and third floors allotted already thereto. Suppose that a new up hall call is originated from the second floor in such a state. Then, the output signal VS2UA of the circuit shown in FIG. 18 has a level as described below.

It is supposed that the reference voltage $V_P$ is set at 10 volts, and the weight coefficients $k_1$ and $k_2$ in the equation (2) are selected to be 5 and 2 respectively. Then, the relation among the resistance values of the resistors $r_1$ to $r_8$ can be sought from the following equations:

$$\left.\begin{aligned} k_1 &= \frac{r_9}{r_2} = \frac{r_9}{r_3} = \frac{r_9}{r_6} = \frac{r_9}{r_7} = 5 \\ k_2 &= \frac{r_9}{r_1} = \frac{r_9}{r_4} = \frac{r_9}{r_5} = \frac{r_9}{r_8} = 2 \end{aligned}\right\} \quad (5)$$

$$\left.\begin{aligned} r_2 = r_3 = r_6 = r_7 &= 5\, r_9 \\ r_1 = r_4 = r_5 = r_8 &= 2\, r_9 \end{aligned}\right\} \quad (6)$$

The resistance value of the resistor $r_9$ in the above equations is suitably selected.

The output voltage V of the operational amplifier AD2UA3 is given by $$V = 5 \times 2 + 2 \times 1 = 12 \text{ volts,}$$

since the contacts $H2CU_a$ and $DNA_a$ are turned on, and the relay contacts $Ry1UA_a$, $Ry3UA_a$ and $2CA_a$ are also turned on.

Suppose further that there are no forecast stop-demanding calls, and the length of time required for the elevator car to stop at one of the floors and that for the elevator car to run one floor interval are 10 seconds and 2 seconds respectively. Then, the voltage signal AN2UA representative of the forecast waiting time has a voltage level given by $10 \times 2 + 2 \times 4 = 28$ volts and appears in response to the origination of the new up hall call from the second floor. Therefore, the voltage level of the voltage signal VS2UA is given by $28 - 12 = 16$ volts. This voltage level takes into account the stop-demanding new up hall call originated from the second floor. Thus, the higher the output voltage V of the operational amplifier AD2UA3, the lower is the voltage level of the voltage signal VS2UA. This means that the new up hall call is presumed to be preferentially allotted to the elevator car A since the voltage signal VS2UA has a lower level than the others.

The output signals VS2UA, VS2UB and VS2UC of the circuit shown in FIG. 18 are applied to the circuit shown in FIG. 13 so that an elevator car providing a minimum forecast waiting time can be selected. As described with reference to FIG. 13, the output signal L2UA of this circuit is only of "1" level. That is, an input signal having a minimum voltage level is selected from among the input signals, and the output signal corresponding to the selected elevator car appears from the minimum selection circuit shown in FIG. 13.

When the relays E2UA1 and E2UA2 are energized in FIGS. 9 and 10, their relay contacts $E2UA1_b$ and $E2UA2_b$ are turned off in FIG. 18 to inhibit the appearance of, for example, the output signal VS2UA which is applied to the minimum selection circuit shown in FIG. 13. In such a case, the voltage $P_o$ is applied to the cathode of the diodes to prevent erroneous operation of the minimum selection circuit.

In the manner above described, the output signal representative of the minimum evaluated time applied from the circuit shown in FIG. 18 is selected to select the most suitable elevator car. The signal L2UA, L2UB or L2UA representative of the selected elevator car is applied from the circuit shown in FIG. 13 to the hall call allotment circuit shown in FIG. 14.

In the second embodiment of the present invention, the predetermined floor range is selected to cover two backward floors and two forward floors contiguous to a new up hall call originating floor to prevent the bunched running of the elevator cars as described with reference to FIG. 18. However, this predetermined floor range may include more backward and forward floors. Generally, this predetermined floor range is selected to include two or three backward and forward floors. Instead of selecting the predetermined floor range to include both a plurality of backward floors and a plurality of forward floors contiguous to a new hall call originating floor, this predetermined floor range may be selected to include either a plurality of backward floors or forward floors only. In this case, however, the effect will be less marked than that obtained when the predetermined floor range is selected to include both the backward floors and the forward floors contiguous to the new hall call originating floor.

In the second embodiment of the present invention, the weight coefficients $k_1 = 5$ and $k_2 = 2$ are selected to determine the resistance values of the resistors $r_1$ to $r_8$. Although the weight coefficient $k_1$ for the first backward floor contiguous to a new hall call originating floor is selected to be equal to that for the first forward floor, and the weight coefficient $k_2$ for the second backward floor is also selected to be equal to that for the second forward floor, different weight coefficients may be employed for these backward and forward floors so that the evaluated time for each of these floors can be more finely defined.

In such a case, the following equation can be derived from the equation (2):

$$T_A^P = m_1 \cdot N_A^{P-2} + m_2 \cdot N_A^{P-1} + m_3 \cdot N_A^{P+1} + m_4 \cdot N_A^{P+2}$$

where $m_1$ to $m_4$ are weight coefficients.

For example, the relation $m_1 > m_2 > m_3 > m_4$ may be provided among the weight coefficients $m_1$, $m_2$, $m_3$ and $m_4$ for the (P−2)th, (P−1)th, (P+1)th and (P+2)th floors respectively so as to minimize the tendency of an already allotted hall call waiting time from being excessively extended. When a new up hall call is allotted to one of the elevator cars, the waiting time at a forward floor having originated a hall call allotted to this elevator car will be extended by the length of time required for the elevator car to stop at the new hall call originating floor, resulting in an extended waiting time. On the other hand, the waiting time at a floor lying backward of this new hall call originating floor and having originated a hall call allotted to this elevator car is not affected by this new up hall call. It will be seen from the above description that the effect can be improved when the weight coefficients for the floors lying backward of the new hall call originating floor are determined to be slightly larger than those for the forward floors.

In the second embodiment of the present invention described with reference to FIG. 18, the weight coefficient for an already allotted hall call is selected to be equal to that for an already registered car call. However, the weight coefficient $n_1$ for an already allotted hall call is preferably selected to be larger than the weight coefficient $n_2$ for an already registered car call. In this case, the forecast waiting time $Wt_A^P$ given by the equation (1) is re-written as follows:

$$Wt_A^P = \alpha\,(n_1 \cdot H_A + n_2 \cdot C_A + n_3 \cdot F_A) + \beta \cdot R_A$$

This new expression is preferred because the elevator car responding to one hall call has generally a plurality of car calls registered therein, and the weight of one hall call is greater than that of one car call.

Figure 19:
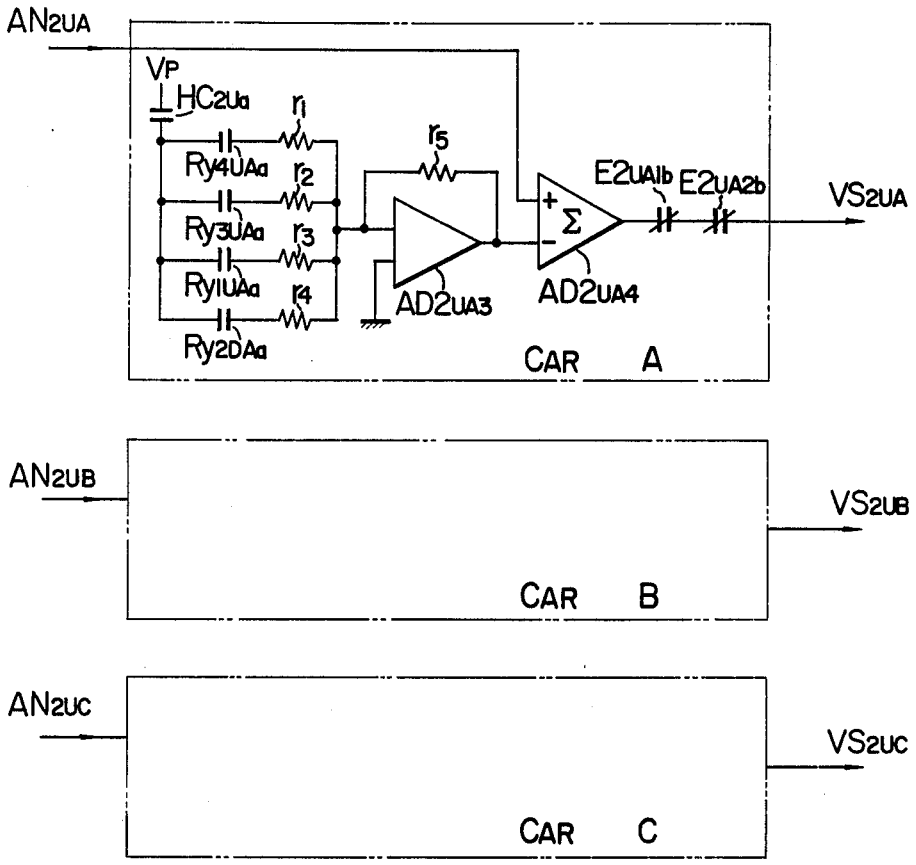
FIG. 19 shows a modification of the circuit shown in FIG. 18.

FIG. 19 shows a modification of the circuit shown in FIG. 18, and this modification is based on the above concept. This modification differs from the second embodiment in that car call information is eliminated and already allotted hall call information is solely taken into account for the control, utilizing the fact that car calls do not appreciably contribute to the effect of preventing the bunched running. The operation of the circuit shown in FIG. 19 is similar to that of the circuit shown in FIG. 18 and will not be described herein.

In the second embodiment of the present invention, the resistors $r_1$ to $r_8$ have fixed resistance values, and thus, the weight coefficients $k_1$ and $k_2$ in the equation (2) are also set at predetermined values. However, these resistors $r_1$ to $r_8$ may have resistance values variable depending on the traffic demand, etc., and thus, the values of the weight coefficients $k_1$ and $k_2$ may also be varied dynamically.

According to one method of detecting the traffic demand, the daily traffic demand is classified into various patterns including an office-going time pattern, a lunchtime pattern, an office-leaving time pattern and a non-busy time pattern, on the basis of various detected factors including the load value of up-moving elevator cars, the load value of down-moving elevator cars, the number of up hall calls, and the number of down hall calls. Such a method is disclosed in, for example, U.S. Pat. No. 3,642,099 and British Pat. No. 1,280,702. According to another detecting method, the daytime is classified into a plurality of time zones such as an office-going time zone, a lunchtime zone and an office-leaving time zone for indirectly detecting the traffic demand by the time.

The traffic demand signals detected by such method may therefore be used for automatically varying the resistance values of the resistors $r_1$ to $r_8$ so as to suitably vary the weight coefficients $k_1$ and $k_2$ depending on the traffic demand.

A third embodiment of the present invention will next be described with reference to FIGS. 1, 2B and 20 to 22.

In the first and second embodiments of the present invention, a most suitably elevator car is selected on the basis of the forecast waiting time, that is, the length of time required for each individual elevator car to arrive at a new up hall call originating floor as shown in the equation (1), and this new up hall call is allotted to an elevator car providing a minimum forecast waiting time. In other words, the basic idea of these embodiments is to allot the new up hall call to an elevator car which is forecast to be capable of arriving at the new hall call originating floor with the shortest length of time. In some cases, however, this manner of hall call allotment is not necessarily the best.

Such a case will be described with reference to FIG. 1 again. Suppose now that a new up hall call is originated from the sixth floor in the state shown in FIG. 1. As described hereinbefore, the forecast waiting times $Wt_A^6$, $Wt_B^6$ and $Wt_C^6$ at the sixth floor are 18 seconds, 16 seconds and 44 seconds in the cases of the elevator cars A, B and C respectively, and the elevator car B can arrive at the sixth floor with the shortest length of time. (The values of the equation (2) are not considered herein since the method of allotment is now discussed.)

However, due to the fact that an up hall call originated from the eighth floor is already allotted to the elevator car B, the forecast waiting time at the eighth floor is increased by the length of time of, for example, about 10 seconds required to stop at the sixth floor when the new up hall call from the sixth floor is allotted to the elevator car B. Thus, the forecast waiting time at the eighth floor tends to be extended, and when the system is designed to display the forecast waiting time in the hall, the displayed forecast waiting time is increased from the previous value. This is not a favorable situation.

Such an unfavorable situation occurs due to the fact that a new hall call originating floor is only taken into consideration. It is therefore necessary to allot such a new up hall call taking into account the influence of the same on the waiting time at all the individual floors having originated hall calls allotted already to the elevator cars.

In the third embodiment of the present invention, such an unfavorable situation can be obviated by allotting a new up hall call in a manner as described below. In response to the origination of a new up hall call from a *P*th floor, the forecast waiting time at the *P*th floor originating the new up hall call and that at each of the floors lying forward of the *P*th floor and having originated hall calls are computed for each of the three elevator cars A, B and C. Then, the maximum forecast waiting time is sought for each of the three elevator cars A, B and C, as follows:

$$\left.\begin{array}{l} \underset{A}{\mathrm{Max}}\{ Wt_A^P, Wt_A^{P+l_{A1}}, Wt_A^{P+l_{A2}}, \quad \} \\ \underset{B}{\mathrm{Max}}\{ Wt_B^P, Wt_B^{P+l_{B1}}, Wt_B^{P+l_{B2}}, \quad \} \\ \underset{C}{\mathrm{Max}}\{ Wt_C^P, Wt_C^{P+l_{C1}}, Wt_C^{P+l_{C2}}, \quad \} \end{array}\right\} \quad (7)$$

where $l_{A1}, l_{A2} \ldots l_{B1}, l_{B2} \ldots l_{C1}, l_{C2} \ldots$ :

Number of floors having originated hall calls alloted already to the elevator cars A, B and C in the floor range forward of the *P*th floor originating the new hall call.

The maximum forecast waiting times given by the condition (7) are now designated max $T_A$, max $T_B$ and max $T_C$ respectively.

Then, the new hall call is allotted to an elevator car which provides a minimum value among these maximum forecast waiting times. That is, the new hall call is allotted to an elevator car which satisfies the following condition:

$$\mathrm{Min}\{\max T_A, \max T_B, \max T_C\} \quad (8)$$

It will be seen that a new up hall call is allotted taking into account the forecast waiting time at all the individual floors having originated hall calls, that is, such new hall call is allotted so as to minimize long-waiting hall calls. Thus, long-waiting hall calls can be minimized, and the average waiting time can also be reduced.

The basic concept of new hall call allotment employed in the third embodiment of the present invention is as above described. This new hall call allotting method will be described with reference to FIG. 2B.

Figure 2B:
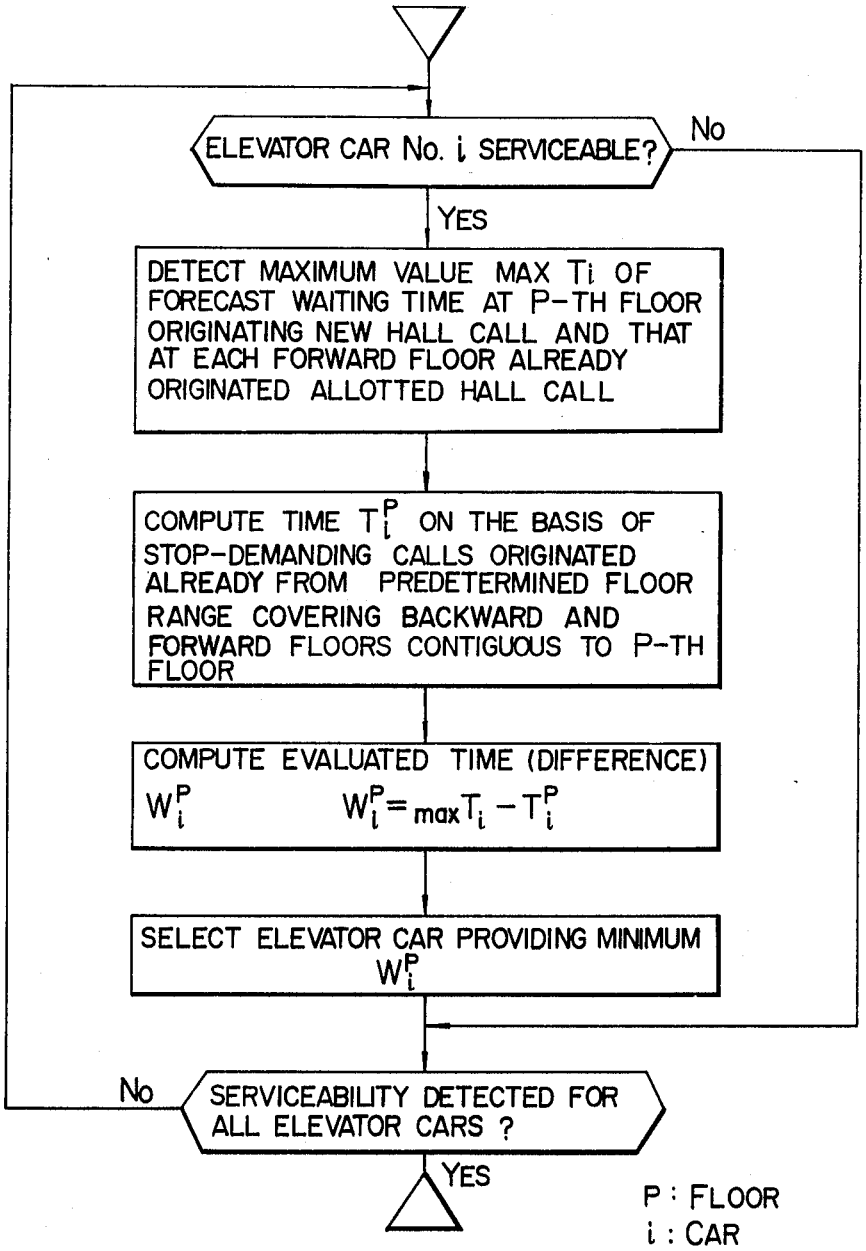
FIG. 2B is a flow chart illustrating the outline of the basic operation of the third embodiment of the present invention.

FIG. 2B is a flow chart illustrating the outline of the basic operation of the third embodiment of the present invention, and it is supposed that the three elevator cars A, B and C are initially located in a state as shown in FIG. 1.

In the first step, the serviceability of each of the elevator cars A, B and C for the *P*th floor originating the new up hall call is detected. An elevator car is said to be non-serviceable when it is full loaded before arriving at the *P*th floor or it provides an excessively long waiting time or it is disabled due to trouble. When one of the elevator cars is found non-serviceable, the step above described is repeated for another elevator car. When all these three elevator cars A, B and C are found serviceable, the maximum forecast waiting times are computed according to the condition (7). In the state shown in FIG. 1, these maximum forecast waiting times associated with the elevator cars A, B and C are computed, as follows:

$$\underset{A}{\mathrm{Max}}\{ 18_A^6, 0 \} \longrightarrow \max T_A = 18 \text{ seconds}$$

$$\underset{B}{\mathrm{Max}}\{ 16_B^6, 30_B^8, 0 \} \longrightarrow \max T_B = 30 \text{ seconds}$$

$$\underset{C}{\mathrm{Max}}\{ 44_C^6, 0 \} \longrightarrow \max T_C = 44 \text{ seconds}$$

Then, the values of $T_A^6$, $T_B^6$ and $T_C^6$ are computed according to the equation (2), as follows:

$$T_A^6 = 10 \text{ seconds}$$

$$T_B^6 = 4 \text{ seconds}$$

$$T_C^6 = 0 \text{ second}$$

Then, the evaluated time $W_i^P$ (*i*: the elevator car No.) associated with each of the elevator cars A, B and C is computed according to the equation (3), as follows:

$$W_A^6 = \max T_A - T_A^6 = 18 - 10 = 8 \text{ seconds}$$

$$W_B^6 = \max T_B - T_B^6 = 30 - 4 = 26 \text{ seconds}$$

$$W_C^6 = \max T_C - T_C^6 = 44 - 0 = 44 \text{ seconds}$$

From the condition (4), therefore, $W_A^6 = 8$ seconds is the minimum evaluated time for the new up hall call originated from the sixth floor, and this new up hall call is allotted to the elevator car A. It is thus apparent that this manner of new hall call allotment is as effective as the second embodiment in preventing the bunched running of the elevator cars.

Figure 20:
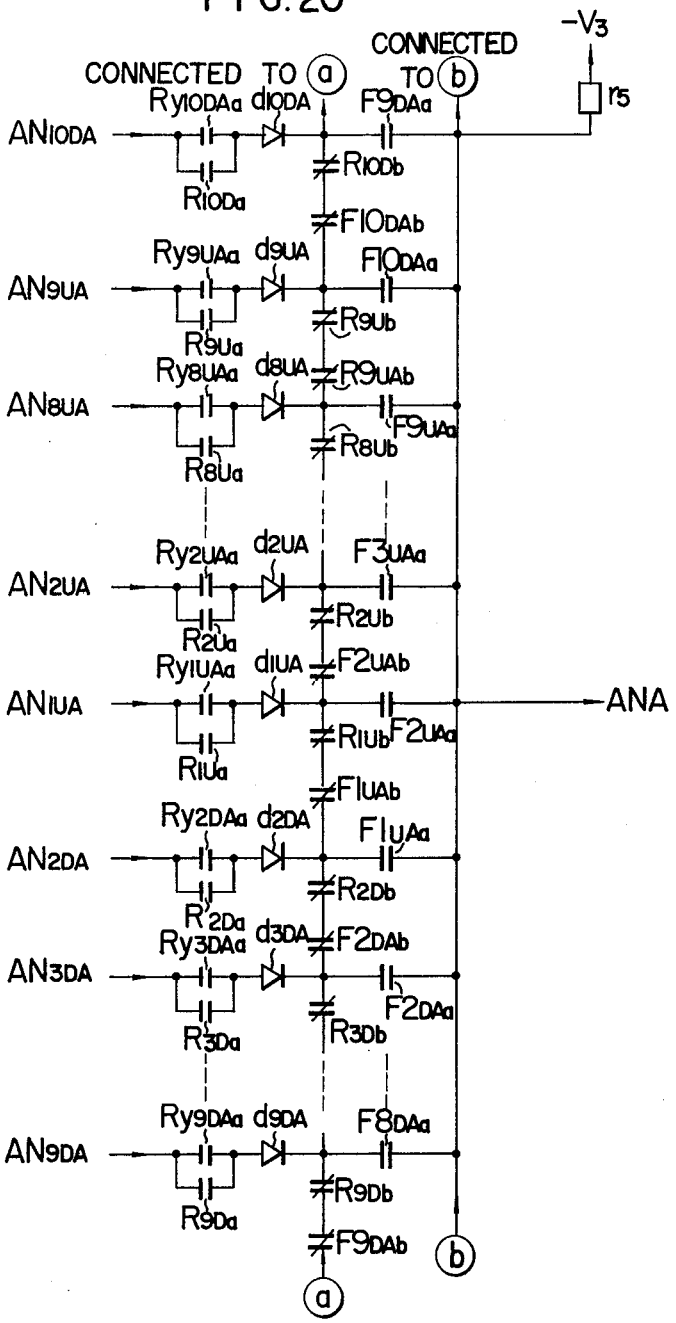
FIG. 20 is a circuit diagram of a circuit used in the third embodiment for computing a maximum waiting time.

The practical structure of circuits employed in the third embodiment of the present invention will now be described with reference to FIGS. 20 to 22 which show only those circuits which differ from the corresponding circuits employed in the first and second embodiments. This third embodiment differs markedly from the first and second embodiments in that it includes additional means for computing the maximum forecast waiting times according to the condition (7). FIG. 20 shows a circuit for computing the maximum forecast waiting times.

The inputs to the circuit shown in FIG. 20 are the output signals of FIG. 7 representative of the computed forecast waiting times. In response to the application of such input signals, the maximum forecast waiting time at a floor originating a new up hall call and that at each of the floors lying forward of the new hall call originating floor and having originated an already allotted hall call are detected for each of the three elevator cars A, B and C.

Referring to FIG. 20, relay contacts $R1U_a$ to $R10D_a$ and relay contacts $R1U_b$ to $R10D_b$ are turned on and off respectively when an up hall call originated from the first floor . . . and a down hall call originated from the 10th floor are not yet allotted to anyone of the three elevator cars A, B and C. Relays R1U to R10D having these relay contacts are shown in FIG. 22. Relay contacts $F1UA_a$ to $F10DA_a$ are turned on when the elevator car A is located at the first to ninth floors for upward movement and at the 10th to second floors for downward movement, respectively. The circuit includes diodes *d*1UA to *d*10DA, a resistor $r_5$ and a negative power supply $-V_3$. The output signals representative of the forecast waiting times at a new hall call originating floor and at already allotted hall call originating floors are selectively applied from the circuit shown in FIG. 7 to the anode of the corresponding diodes in the circuit shown in FIG. 20.

Suppose, for example, that the elevator car A is located at the first floor for upward movement. Then, the relay contacts $F1UA_a$ and $F1UA_b$ are turned on and off respectively. Suppose further that on up hall call, another up hall call, and a down hall call originated from the second, ninth and 10th floors respectively are allotted already to the elevator car A. Then, the relay contacts $Ry2UA_a$, $Ry9UA_a$ and $Ry10DA_a$ are in the on position. In response to the origination of a new up hall call from the eighth floor, the relay contact $HC8U_a$ in FIG. 7 is turned on. However, this new up hall call is not yet allotted to anyone of the elevator cars, and the relay contacts $R8U_a$ and $R8U_b$ are turned on and off respectively in FIG. 20.

In this case, the route for the signal AN8UA is established which is traced from $R8U_a$-d8UA -$F9UA_b$-$F9U_b$-$F10DA_b$ . . . $R2D_b$-$F1UA_a$-$r_5$ to $-V_3$, and the route for the signal AN9UA is established which is traced from $Ry9UA_a$-*d*9UA-$F10DA_b$-$R10D_b$. . . $R2D_b$-$F1UA_a$-$r_5$ to $-V_3$, while the route for the signal AN10DA is established which is traced from $Ry10dA_a$-*d*10DA-$F9DA_b$-$R9D_b$. . . $R2D_b$-$F1UA_a$-$r_5$ to $-V_3$. The diodes *d*8UA, *d*9UA and *d*10DA and the resistor $r_5$ constitute a maximum selection circuit.

Due to the fact that the resistor $r_5$ is connected to the negative power supply $-V_3$, one of the diodes applied with the highest input voltage among those provided by the signals AN8UA, AN9UA and AN10DA conducts solely, and the voltage which is the difference between the highest input voltage and the diode forward voltage drop appears at the cathode of the conducting diode. This voltage is applied to the other diodes in the reverse direction to render these diodes non-conducting.

Suppose now that the voltage signals AN8UA, AN9UA and AN10DA have voltage levels of, for example, 4 volts, 7 volts and 5 volts, respectively. Then, the voltage signal AN9UA having the highest voltage level of 7 volts representative of the forecast waiting time at the ninth floor originating the up hall call already is applied through the diode *d*9UA to appear as a voltage signal ANA representative of the maximum forecast waiting time associated with the elevator car A. This voltage signal ANA appears as an output of the circuit shown in FIG. 20 in lieu of the output signal AN2UA of the circuit shown in FIG. 18. Other circuits are similar to those described with reference to the first and second embodiments.

Figure 21:
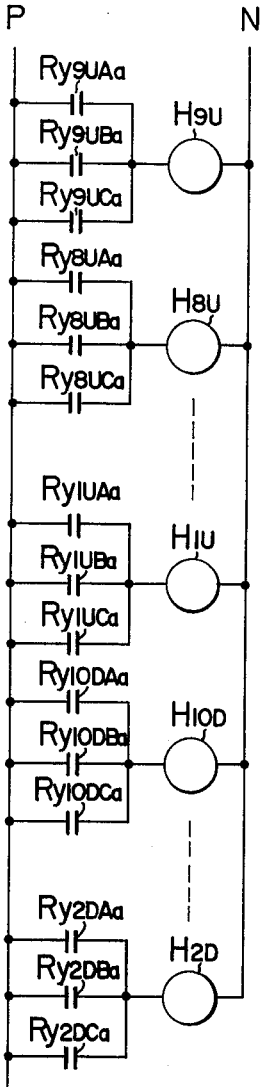
FIGS. 21 and 22 are circuit diagrams of relay circuits used in the third embodiment.

FIG. 21 shows a relay circuit in which one of relays H1U to H9U and H2D to H10D is energized in response to the allotment of the corresponding hall call to one of the elevator cars A, B and C.

Figure 22:
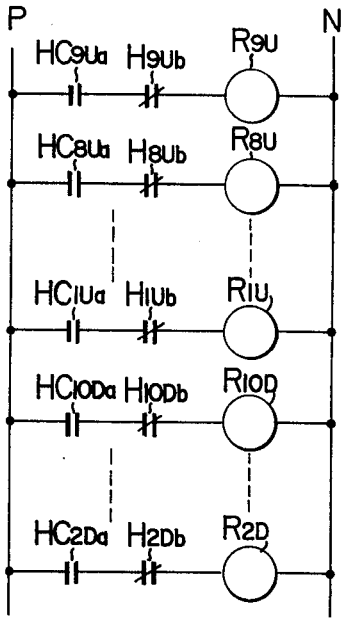

FIG. 22 shows a relay circuit in which one of relays R1U to R10D is energized when the corresponding hall call is not yet allotted to anyone of the elevator cars as described hereinbefore.

The third embodiment of the present invention described with reference to FIGS. 20 to 22 exhibits the effect similar to that exhibited by the first and second embodiments. This third embodiment is effective in minimizing long-waiting hall calls compared with the first and second embodiments, since it is especially adapted for minimizing such long-waiting hall calls. It is apparent that the third embodiment is as effective as the first and second embodiments in preventing the bunched running of the elevator cars.

Although the individual embodiments have been described with reference to the manner of control using analog signals, it is apparent to those skilled in the art that the scope of the present invention includes also the use of digital signals. Further, a miniature computer may be employed, and suitable software may be prepared to exhibit the effect similar to that exhibited by the present invention.

It will be understood from the foregoing detailed description of the present invention that a new hall call originated from one of the floors can be possibly allotted to an elevator car which has a greater number of stop-demanding calls (already allotted hall calls and already registered car calls) in the vicinity of the new hall call originating floor than the others. Therefore, this elevator car can efficiently service the new hall call, and the prior art disadvantage, for example, the bunched running of the elevator cars can be completely obviated. Thus, the individual elevator cars can be uniformly distributed within the entire floor range of the building to provide uniform service for all the hall calls. It is therefore possible to make substantially uniform and shorten the average waiting time at the individual floors and to minimize long-waiting hall calls.

We claim:

1. An elevator control system for controlling a plurality of elevator cars arranged for parallel operation for servicing a plurality of floors of a building, comprising hall call registering means disposed at each floor, car call registering means disposed in each said elevator car for instructing target floors, means for selecting a suitable one of said elevator cars in response to the origination of a new hall call from one of the floors, and means for allotting this new hall call to said selected elevator car so that said selected elevator car can service this new hall call, wherein the improvement comprises means for detecting for each said elevator car the number of already instructed stopping floors within a predetermined floor range covering a plurality of backward or forward floors contiguous to said new hall call originating floor, and means for preferentially allotting the new hall call to one of said elevator cars having said already instructed stopping floors within said predetermined floor range.

2. An elevator control system as claimed in claim 1, wherein said preferential allotting means allots preferentially said new hall call to one of said elevator cars having said already instructed stopping floors within the range of the backward floors contiguous to said new hall call originating floor.

3. An elevator control system as claimed in claim 1, wherein said preferential allotting means allots preferentially said new hall call to one of said elevator cars having said already instructed stopping floors within the range of the forward floors contiguous to said new hall call originating floor.

4. An elevator control system as claimed in claim 1, wherein said preferential allotting means allots preferentially said new hall call to the elevator car having an already allotted stop-demanding hall call among those having said already instructed stopping floors within said predetermined floor range.

5. An elevator control system as claimed in claim 1, wherein said preferential allotting means allots preferentially said new hall call to the elevator car having an already instructed stopping floor nearest to said new hall call originating floor among those having said already instructed stopping floors within said predetermined floor range.

6. An elevator control system as claimed in claim 1, further comprising forecast waiting time computing means for computing for each said elevator car the forecast length of time required to arrive at said new hall call originating floor, said preferential allotting means allotting preferentially said new hall call to the elevator car providing a minimum forecast waiting time among those having said already instructed stopping floors within said predetermined floor range.

7. An elevator control system as claimed in claim 1, wherein said preferential allotting means allots preferentially said new hall call to the elevator car having a greatest number of said already instructed stopping floors among those having said already instructed stopping floors within said predetermined floor range.

8. An elevator control system as claimed in claim 1, wherein said predetermined floor range is selected to cover the same number of backward and forward floors contiguous to said new hall call originating floor.

9. An elevator control system as claimed in claim 1, wherein said predetermined floor range is selected to cover different numbers of backward and forward floors contiguous to said new hall call originating floor.

10. An elevator control system as claimed in claim 1, wherein said allotting means comprises means for determining the serviceability of each said elevator car for said new hall call originating floor, that is, means for detecting whether or not the loading capacity is exceeded before arrival at said new hall call originating floor, and means for detecting for each said elevator car whether or not the forecast length of time required for arrival at said new hall call originating floor exceeds a predetermined limit.

11. An elevator control system as claimed in claim 1, wherein said allotting means comprises means for detecting for each said elevator car to number of said already instructed stopping floors, within said predetermined floor range, means for computing weighted evaluated values for said detected already instructed stopping floors by employing weight coefficients which are successively reduced with the increase in the distance from said new hall call originating floor, means for computing for each said elevator car the sum of said weighted evaluated values for said detected already instructed stopping floors, and means for preferentially allotting said new hall call to the elevator car providing a maximum sum among those of said weighted evaluated values.

12. An elevator control system as claimed in claim 1, wherein said allotting means comprises means for detecting for each said elevator car the number of said already instructed stopping floors within said predetermined floor range, means for computing weighted evaluated values for said detected already instructed stopping floors by employing weight coefficients which are successively reduced with the increase in the distance from said new hall call originating floor, means for computing for each said elevator car the sum of said weighted evaluated values for said detected already instructed stopping floors, means for computing for each said elevator car the evaluated value corresponding to the forecast waiting time or the forecast length of time required to arrive at said new hall call originating floor, means for computing for each said elevator car the difference between the evaluated value corresponding to said forecast waiting time and the sum of said weighted evaluated values for said detected already instructed stopping floors, and means for preferentially allotting said new hall call to the elevator car providing a minimum difference among said differences.

13. An elevator control system as claimed in claim 1, wherein said allotting means comprises means for detecting for each said elevator car the number of said already instructed stopping floors within said predetermined floor range, means for computing weighted evaluated values for said detected already instructed stopping floors by employing weight coefficients which are successively reduced with the increase in the distance from said new hall call originating floor, means for computing for each said elevator car the sum of said weighted evaluated values for said detected already instructed stopping floors, means for computing for each said elevator car the evaluated value corresponding to a maximum forecast waiting time or a maximum forecast length of time among those required to arrive at said new hall call originating floor and at the already allotted hall call originating floors in the forward floor range contiguous to said new hall call originating floor, means for computing for each said elevator car the difference between said evaluated value corresponding to said maximum forecast waiting time and the sum of said weighted evaluated values for said detected already instructed stopping floors, and means for preferentially allotting said new hall call to the elevator car providing a minimum difference among said differences.

14. An elevator control system as claimed in claim 1, wherein said allotting means comprises means for detecting for each said elevator car the number of said already instructed stopping floors within said predetermined floor range, means for computing weighted evaluated values for said detected already instructed stopping floors by employing weight coefficients which vary depending on the position of said detected already instructed stopping floors either backward or forward relative to said new hall call originating floor, means for computing for each said elevator car the sum of said weighted evaluated values for said detected already instructed stopping floors, and means for preferentially allotting said new hall call to the elevator car providing a maximum sum among those of said weighted evaluated values.

15. An elevator control system as claimed in claim 1, wherein said allotting means comprises means for detecting for each said elevator car the number of said already instructed stopping floors within said predetermined floor range, means for computing weighted evaluated values for said detected already instructed stopping floors by employing weight coefficients which vary depending on the position of said detected already instructed stopping floors either backward or forward relative to said new hall call originating floor, means for computing for each said elevator car the sum of said weighted evaluated values for said detected already instructed stopping floors, means for computing for each said elevator car the evaluated value corresponding to the forecast waiting time or forecast length of time required for arrival at said new hall call originating floor, means for computing for each said elevator car the difference between said evaluated value corresponding to said forecast waiting time and the sum of said weighted evaluated values for said detected already instructed stopping floors, and means for preferentially allotting said new hall call to the elevator car providing a minimum difference among said differences.

16. An elevator control system as claimed in claim 1, wherein said allotting means comprises means for computing for each said elevator car the number of said already instructed stopping floors within said predetermined floor range, means for computing weighted evaluated values for said detected already instructed stopping floors by employing weight coefficients which vary depending on the position of said detected already instructed stopping floors either backward or forward relative to said new hall call originating floor, means for computing for each said elevator car the sum of said weighted evaluated values for said detected already instructed stopping floors, means for computing for each said elevator car the evaluated value corresponding to a maximum forecast waiting time or a maximum forecast length of time among those required to arrive at said new hall call originating floor and at the already allotted hall call originating floors in the forward floor range contiguous to said new hall call originating floor, means for computing for each said elevator car the difference between said evaluated value corresponding to said maximum forecast waiting time and the sum of said weighted evaluated values for said detected already instructed stopping floors, and means for preferentially allotting said new hall call to the elevator car providing a minimum difference among said differences.

17. An elevator control system as claimed in claim 12, wherein said means for computing for each said elevator car the evaluated value corresponding to the forecast length of time required to arrive at said new hall call originating floor computes the evaluated value by employing a greater weight coefficient for a hall call than that for a car call.

18. An elevator control system as claimed in claim 13, wherein said means for computing for each said elevator car the evaluated value corresponding to the maximum forecast waiting time computes the evaluated value by employing a greater weight coefficient for a hall call than that for a car call.

19. An elevator control system as claimed in claim 15, wherein said means for computing for each said elevator car the evaluated value corresponding to the forecast length of time required to arrive at said new hall call originating floor computes the evaluated value by employing a greater weight coefficient for a hall call than that for a car call.

20. An elevator control system as claimed in claim 16, wherein said means for computing for each said elevator car the evaluated value corresponding to the maximum forecast weighting time computes the evaluated value by employing a greater weight coefficient for a hall call than that for a car call.

21. An elevator control system as claimed in claim 11, wherein said weighting means provides weight coefficients which are variable depending on the traffic demand.

22. An elevator control system as claimed in claim 12, wherein said weighting means provides weight coefficients which are variable depending on the traffic demand.

23. An elevator control system as claimed in claim 13, wherein said weighting means provides weight coefficients which are variable depending on the traffic demand.

24. An elevator control system as claimed in claim 14, wherein said weighting means provides weight coefficients which are variable depending on the traffic demand.

25. An elevator control system as claimed in claim 15, wherein said weighting means provides weight coefficients which are variable depending on the traffic demand.

26. An elevator control system as claimed in claim 16, wherein said weighting means provides weight coefficients which are variable depending on the traffic demand.

* * * * *